US007245276B2

(12) United States Patent
Yamada

(10) Patent No.: US 7,245,276 B2
(45) Date of Patent: Jul. 17, 2007

(54) CONTROL CIRCUIT FOR ELECTRONIC DEVICES, ELECTRONIC CIRCUIT, ELECTRO-OPTICAL APPARATUS, DRIVING METHOD FOR ELECTRO-OPTICAL APPARATUS, ELECTRONIC SYSTEM, AND CONTROL METHOD FOR ELECTRONIC DEVICES

(75) Inventor: Tadashi Yamada, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 315 days.

(21) Appl. No.: 10/419,814

(22) Filed: Apr. 22, 2003

(65) Prior Publication Data

US 2004/0048069 A1 Mar. 11, 2004

(30) Foreign Application Priority Data

Apr. 24, 2002 (JP) ..... 2002-122811
Apr. 21, 2003 (JP) ..... 2003-116367

(51) Int. Cl.
*G09G 3/30* (2006.01)

(52) U.S. Cl. ..... 345/76; 345/211; 345/690; 345/77; 345/84

(58) Field of Classification Search ..... 345/76–84, 345/169.3, 211, 690; 315/169.3
See application file for complete search history.

(56) References Cited

U.S. PATENT DOCUMENTS 5,424,753 A 6/1995 Kitagawa et al.
5,555,000 A 9/1996 Sarrasin et al.
5,623,278 A 4/1997 Okada et al.
6,373,454 B1 4/2002 Knapp et al.
6,753,654 B2 * 6/2004 Koyama ..... 315/169.1
6,819,311 B2 11/2004 Nose et al.
2005/0030264 A1 2/2005 Tsuge et al.
2005/0041002 A1 2/2005 Takahara et al.
2005/0057580 A1 3/2005 Yamano et al.
2005/0225545 A1 10/2005 Takatori et al.

FOREIGN PATENT DOCUMENTS

JP A-01-195783 8/1989
JP A-04-044478 2/1992
JP A-4-136983 5/1992
JP A-04-204628 7/1992
JP A-4-328791 11/1992
JP A-4-353823 12/1992
JP A-7-181916 7/1995
JP A-7-181917 7/1995
JP A 11-237606 8/1999
JP A-11-237606 8/1999
JP A-11-326870 11/1999
JP A-2000-56727 2/2000

(Continued)

*Primary Examiner*—Richard Hjerpe
*Assistant Examiner*—Duc Dinh
(74) *Attorney, Agent, or Firm*—Oliff & Berridge, PLC

(57) ABSTRACT

A data-line drive circuit controls a current value of a control signal in every cycle $T_1$ based on upper 8-bit digital data DAB of digital data In, and performs pulse-width control in a cycle $T_2$ based on lower 2-bit digital data SUB of the digital data In for the portion which is D/A-converted based on the same digital data of the control signal. It is thus possible to provide an electronic circuit suitable to inhibit a variation in the luminance so as to control the luminance levels of pixels with high precision.

7 Claims, 17 Drawing Sheets

FOREIGN PATENT DOCUMENTS

| | | |
|---|---|---|
| JP | A-2000-347622 | 12/2000 |
| JP | A-2001-56667 | 2/2001 |
| JP | A-2001-147676 | 5/2001 |
| JP | A-2001-166280 | 6/2001 |
| JP | A-2001-210122 | 8/2001 |
| JP | A-2002-517806 | 6/2002 |
| JP | A-2003-114638 | 4/2003 |
| JP | A-2003-150104 | 5/2003 |
| JP | A-2003-150109 | 5/2003 |
| JP | A-2003-216100 | 7/2003 |
| TW | 331679 | 5/1998 |
| WO | WO 98/36407 | 8/1998 |
| WO | WO 99/65011 | 12/1999 |
| WO | WO 03/023750 | 3/2003 |
| WO | WO 03/023752 | 3/2003 |
| WO | WO 03/027998 | 4/2003 |

* cited by examiner (a)

<EXAMPLES OF CHANGE IN Iout BY ADJUSTING PARAMETERS>

| | EXAMPLE 1 | EXAMPLE 2 | EXAMPLE 3 | EXAMPLE 4 | EXAMPLE 5 |
|---|---|---|---|---|---|
| GRAYSCALE LEVEL | STANDARD | VRIN HIGHER | VDREF HIGHER | Ka GREATER | Kb GREATER |
| 1 | 520 | 1040 | 780 | 364 | 920 |
| 15 | 800 | 1600 | 1200 | 560 | 1200 |
| 31 | 1120 | 2240 | 1680 | 784 | 1520 |
| 63 | 1760 | 3520 | 2640 | 1232 | 2160 |
| 127 | 3040 | 6080 | 4560 | 2128 | 3440 |
| 255 | 5600 | 11200 | 8400 | 3920 | 6000 |
| GRAPH | G1 | G2 | G3 | G4 | G5 |

(Ioffset =500)

(b)

CONTROL CIRCUIT FOR ELECTRONIC DEVICES, ELECTRONIC CIRCUIT, ELECTRO-OPTICAL APPARATUS, DRIVING METHOD FOR ELECTRO-OPTICAL APPARATUS, ELECTRONIC SYSTEM, AND CONTROL METHOD FOR ELECTRONIC DEVICES

TECHNICAL FIELD

The present invention relates to a technique for generating, based on a digital signal, a programming current to be supplied for setting the light-emission grayscale for a pixel circuit of a light-emitting device. More particularly, the invention relates to a control circuit for electronic devices, an electronic circuit, an electro-optical apparatus, a semiconductor integrated circuit device, an electronic system, and a control method for electronic devices, which are suitably used for inhibiting a variation in the luminance so as to control luminance levels of pixels with high precision.

BACKGROUND ART

Electro-optical apparatuses using electro-optical devices such as liquid crystal devices, organic EL devices (Organic Electroluminescent elements), electrophoretic devices, or electron emission devices are suitably used as display apparatuses.

Active-driving electro-optical apparatuses provided with pixel circuits are suitably used as high-performance display apparatuses (for example, see patent document I (pamphlet of International Publication No. WO98/36407)).

In electro-optical apparatuses, however, when adjusting the pixels to a lower luminance level, the luminance level is disadvantageously varied due to a difference of the pixel circuits. Particularly in electro-optical apparatuses provided with current driving devices, such as organic EL devices, the current is directly reflected in the luminance level, and the problem of a luminance variation is noticeable.

There is a further demand for an improvement in moving-picture characteristics and visibility in order to provide display apparatuses with more high-performance functions.

Accordingly, the present invention has been made in view of the above-described unsolved problems unique to the related art. It is an object of the present invention to provide a control circuit for electronic devices, an electronic circuit, an electro-optical apparatus, a semiconductor integrated circuit device, an electronic system, and a control method for electronic devices, which are suitable for inhibiting a variation in the luminance so as to control luminance levels of pixels with high precision.

DISCLOSURE OF INVENTION (First Invention)

In order to achieve the above object, a control circuit for electronic devices according to a first invention is a control circuit for electronic devices for generating a control signal based on a digital signal so as to control the electronic devices by the generated control signal. In this control circuit, the control signal is set in each first period, and the control signal is set in each second period, which is different from the first period.

With this configuration, when a digital signal is supplied, a control signal is generated based on the digital signal. In this case, a control signal is generated in each first period, and the control signal is generated in each second period. Accordingly, electronic devices are driven according to the control signal set as described above.

If the drive period for electronic devices is longer than or equivalent to the longer period of the first period and the second period, for example, the current value is largely adjusted in the amplitude direction by the longer period of the first period and the second period, and the current value is precisely adjusted in the time domain, such as in pulse-width control, by the shorter period of the first period and the second period. Accordingly, the electronic devices can be adjusted relatively with high precision without the need to use small capacitance transistors. In this case, since the final precision is determined by the precision implemented by the control in each first period and the precision implemented by the control in each second period, it is not necessary to set the frequency of the shorter period of the first period and the second period to be as high as that when the same precision is implemented with a digital method.

The setting of the control signal means the setting of the current value or the voltage and other elements of the control signal.

(Second Invention)

A control circuit for electronic devices according to a second invention is a control circuit for electronic devices for generating a control signal based on a digital signal so as to control the electronic devices by the generated control signal. The control circuit includes: first current-value setting means for setting a current value of the control signal in each first period; and second current-value setting means for setting the current value of the control signal in each second period, which is different from the first period.

With this configuration, when a digital signal is supplied, a control signal is generated based on the digital signal. In this case, a current value of the control signal is set in each first period by the first current control means, and a current value of the control signal is set in each second period by the second current control means. Accordingly, electronic devices are driven according to the current value set by the first current control means and the second current control means.

If the drive period for electronic devices is longer than or equivalent to the longer period of the first period and the second period, for example, the current value is largely adjusted in the amplitude direction by the current control means corresponding to the longer period of the first period and the second period, and the current value is precisely adjusted in the time domain, such as in pulse-width control, by the current control means corresponding to the shorter period of the first period and the second period. Accordingly, the electronic devices can be adjusted relatively with high precision without the need to use small capacitance transistors. In this case, since the final precision is determined by the precision implemented by the first current control means and the precision implemented by the second current control means, it is not necessary to set the frequency of the shorter period of the first period and the second period to be as high as that when the same precision is implemented with a digital method.

(Third Invention)

In a control circuit for electronic devices according to a third invention based on the control circuit for electronic devices according to the second invention, the second period is shorter than the first period; the first current-value setting means sets the current value of the control signal in each of the first period based on part of digital data forming the digital signal; and the second current-value setting means sets the current value of the control signal in each of the second period based on the remaining data other than the part of the digital data used by the first current-value setting means for a portion set by the first current-value setting means based on the same digital data of the control signal.

With this configuration, the current value of the control signal is set in each first period by the first current-value setting means based on part of the digital data. The current value of the control signal is also set in each second period by the second current-value setting means based on the remaining data other than the part of the digital data used by the first current-value setting means for a portion set by the first current-value setting means based on the same digital data of the control signal.

(Fourth Invention)

In a control circuit for electronic devices according to a fourth invention based on the control circuit for electronic devices according to the third invention, upper bits of the digital data are assigned to the part of the data, and lower bits of the digital data are assigned to the remaining data.

With this configuration, the current value of the control signal is set in every first period by the first current-value setting means based on the upper bits of the digital data. Also, the current value of the control signal is controlled in every second period by the second current-value setting means based on the lower bits of the digital data for a portion set by the first current-value setting means based on the same digital data of the control signal.

(Fifth Invention)

In order to achieve the above-described object, an electronic circuit according to a fifth invention is an electronic circuit for converting n items of digital data (n is an integer of two or greater) into a control electric signal to be supplied to electronic devices within a predetermined period so as to output the control electronic signal.

The electronic circuit includes sub-period setting means for generating a signal for setting the length of a sub period, which is provided in the predetermined period, for outputting a sub electronic signal based on m items of digital data (m is an integer of one or greater) of the n items of digital data.

In the sub period, the sub electric signal is output as the control electric signal.

With this configuration, a signal for setting the length of a sub period for outputting a sub electronic signal is generated by the sub-period setting means based on m items of digital data (m is an integer of one or greater) of the n items of digital data. In the sub period, the sub electric signal is output as the control electric signal.

In this case, the control electric signal may be generated by performing modulation by switching between the remaining digital data obtained by subtracting m items of digital data from n items of digital data and the data obtained by adding one to the remaining data according to m items of digital data. Alternatively, the control electric signal may be generated by directly D/A-converting the remaining digital data and by adding an electric signal to be modulated by m items of digital data to the D/A-converted output.

The sub period may be set continuously or intermittently in the predetermined period. A plurality of sub periods may be set.

The sub period may be the same as the predetermined period.

The sub-period setting means generates a setting signal by addition. Alternatively, the sub-period setting means may generate a setting signal by subtraction, multiplication, division, and other types of calculations.

(Sixth Invention)

In an electronic circuit according to a sixth invention based on the electronic circuit according to the fifth invention, the sub electric signal is equivalent to an electric signal obtained by adding an addition electric signal to a reference electric signal or a processed electric signal obtained by processing the electric signal in the sub period.

The reference electric signal is an electric signal based on p items of digital data (p is an integer of one or greater) of the remaining data obtained by subtracting m items of digital data from n items of digital data used for setting the length of the sub period, and is not dependent on m items of digital data at least in the sub period.

With this configuration, an electric signal which is based on p items of digital data of the remaining digital data and which is not dependent on m items of digital data at least in the sub period is supplied as the reference electric signal, and in the sub period, an electric signal obtained by adding an addition electric signal to such a reference electric signal, or a processed electric signal obtained by processing the electric signal is output as the control electric signal.

The processed electric signal includes, for example, a signal processed by performing γ correction on an electric signal.

The electric signal may be substantially 0.

(Seventh Invention)

In an electronic circuit according to a seventh invention based on the electronic circuit according to the sixth invention, the addition electric signal is a signal having a current or a voltage which is set to be a first predetermined value in the predetermined period.

With this configuration, a signal having a current or a voltage which is set to be the first predetermined value in the predetermined period is supplied as the addition electric signal, and in the sub period, an electric signal obtained by adding such an addition electric signal to a reference electric signal, or a processed electric signal obtained by processing the electric signal is output as the control electric signal.

(Eighth Invention)

In an electronic circuit according to an eighth invention based on the electronic circuit according to the seventh invention, the reference electric signal is a signal having a current or a voltage which is set to be a second predetermined value in the predetermined period.

With this configuration, a signal having a current or a voltage which is set to be the second predetermined value in the predetermined period is supplied as the reference electric signal, and in the sub period, an electric signal obtained by adding an addition electric signal to such a reference electric signal, or a processed electric signal obtained by processing the electric signal is output as the control electric signal.

(Ninth Invention)

In an electronic circuit according to a ninth invention based on the electronic circuit according to the eighth invention, the first predetermined value is smaller than the second predetermined value.

With this configuration, an electric signal having a voltage or a current which is smaller than the voltage or the current of an addition electric signal is supplied as the reference electric signal, and in the sub period, an electric signal obtained by adding an addition electric signal to such a reference electric signal, or a processed electric signal obtained by processing the electric signal is output.

(Tenth Invention)

In an electronic circuit according to a tenth invention based on the electronic circuit according to the ninth invention, the second predetermined value is set to a value obtained by dividing the difference between the minimum value and the maximum value of the second predetermined value by 2p−1.

With this configuration, an electric signal having a voltage or a current which is set to be a value obtained by dividing the difference between the minimum value and the maximum value of the second predetermined value by 2p−1 is supplied as the reference electric signal, and in the sub period, an electric signal obtained by adding an addition electric signal to such a reference electric signal, or a processed electric signal obtained by processing the electric signal is output.

(Eleventh Invention)

In order to achieve the above-described object, an electro-optical apparatus according to an eleventh invention includes: a pixel matrix in which pixels including light-emitting devices are disposed in a matrix; a plurality of scanning lines respectively connected to pixel groups disposed in one of the row direction and the column direction of the pixel matrix; a plurality of data lines respectively connected to pixel groups disposed in the other one of the row direction and the column direction of the pixel matrix; a scanning-line drive circuit connected to the plurality of scanning lines so as to select one row or one column of the pixel matrix; and a data-line drive circuit for generating, based on a digital signal, a control signal having a current value in accordance with a light-emission grayscale of the light-emitting device, and for outputting the generated control signal to at least one of the plurality of data lines. The data-line drive circuit includes first current-value setting means for setting the current value of the control signal in each first period, and second current-value setting means for setting the current value of the control signal in each second period, which is different from the first period.

With this configuration, the scanning lines are driven by the scanning-line drive circuit, and one row or one column of the pixel matrix is selected. Then, a pixel group disposed in one of the row direction and the column direction of the pixel matrix is selected.

When a digital signal is supplied, a control signal is generated by the data line drive circuit based on the digital signal, and the generated control signal is output to at least one data line of the plurality of data lines. In this case, the current value of the control signal is set in every first period by the first current control means, and the current value of the control signal is set in every second period by the second current control means. When the control signal is output to the data line, it is input into pixel groups disposed in the other one of the row direction and the column direction of the pixel matrix.

Accordingly, the light-emitting devices of the pixels belonging to the pixel group selected by the scanning-line drive circuit and also belonging to the pixel group into which the control signal is input by the data-line drive circuit emit light with the luminance level corresponding to the current value set by the first current control means and the second current control means.

If the drive period for the light-emitting devices is longer than or equivalent to the longer period of the first period and the second period, for example, the current value is largely adjusted in the amplitude direction by the current control means corresponding to the longer period of the first period and the second period, and the current value is precisely adjusted in the time domain, such as in pulse-width control, by the current control means corresponding to the shorter period of the first period and the second period. Accordingly, the light-emitting devices can be adjusted relatively with high precision without the need to use small capacitance transistors. In this case, since the final precision is determined by the precision implemented by the first current control means and the precision implemented by the second current control means, it is not necessary to set the frequency of the shorter period of the first period and the second period to be as high as that when the same precision is implemented with a digital method.

(Twelfth Invention)

In an electro-optical apparatus according to a twelfth invention based on the electro-optical apparatus based on the eleventh invention, the second period is shorter than the first period, the first current-value setting means sets the current value of the control signal in each first period based on part of digital data forming the digital signal, and the second current-value setting means sets the current value of the control signal in each second period based on the remaining data other than the part of the digital data used by the first current-value setting means for a portion set by the first current-value setting means based on the same digital data of the control signal.

With this configuration, the current value of the control signal is set in every first period by the first current-value setting means based on part of the digital data. The current value of the control signal is also set in each second period by the second current-value setting means based on the remaining data other than the part of the digital data used by the first current-value setting means for the portion set by the first current-value setting means based on the same digital data of the control signal.

(Thirteenth Invention)

In an electro-optical apparatus according to a thirteenth invention based on the electro-optical apparatus according to the twelfth invention, the digital data is configured such that an upper bit indicates a higher light-emission grayscale for the light emitting device, upper bits of the digital data are assigned to the part of the digital data, and lower bits of the digital data are assigned to the remaining data.

With this configuration, the current value of the control signal is set in every first period by the first current-value setting means based on the upper bits of the digital data. Also, the current value of the control signal is controlled in every second period by the second current-value setting means based on the lower bits of the digital data for the portion set by the first current-value setting means based on the same digital data of the control signal.

(Fourteenth Invention)

In an electro-optical apparatus according to a fourteenth invention based on the electro-optical apparatus according to the thirteenth invention, the second period is the same period as each of divided areas obtained by equally dividing the first period by the number of bits forming the remaining data.

With this configuration, the current value of the control signal is controlled in every second period by the second current-value setting means for the portion set by the first current-value setting means based on the same digital data of the control signal for each of divided areas obtained by equally dividing the first period by the number of bits forming the remaining data.

(Fifteenth Invention)

In an electro-optical apparatus according to a fifteenth invention based on the electro-optical apparatus according to the thirteenth or fourteenth invention, the digital data is formed of 4n(n≧1)-bit data, upper 3n-bit data of the digital data is assigned to the part of the data, and lower n-bit data of the digital data is assigned to the remaining data.

With this configuration, the current value of the control signal is set in every first period by the first current-value setting means based on the upper 3*n* bits of the digital data. Also, the current value of the control signal is controlled in every second period by the second current-value setting means based on the lower n bits of the digital data for the portion set by the first current-value setting means based on the same digital data of the control signal.

(Sixteenth Invention)

In an electro-optical apparatus according to a sixteenth invention based on the electro-optical apparatus set forth in any one of the eleventh through fifteenth invention, the light-emitting devices are organic electroluminescence devices.

With this configuration, the organic electroluminescence devices of the pixels belonging to the pixel group selected by the scanning-line drive circuit and also belonging to the pixel group into which the control signal is input by the data-line drive circuit emit light with the luminance level corresponding to the current value set by the first current control means and the second current control means.

(Seventeenth Invention)

An electro-optical apparatus according to a seventeenth invention includes a plurality of pixel circuits at intersections of a plurality of scanning lines and a plurality of data lines. In this electro-optical apparatus, data signals to be supplied to the plurality of pixel circuits via the plurality of data lines are generated based on first digital data of a pair of digital data, signal levels to be supplied to electro-optical devices contained in each of the plurality of pixel circuits are determined according to the data signals; and a period control signal for setting at least one sub period for supplying the signal level to the electro-optical device in a main period is generated based on second digital data of the pair of digital data.

With this configuration, at least one sub period or at least one sub frame can be set in the main period, and thus, the time-division grayscale can be utilized. Also, by providing a sub period in the main period, impulse driving can be implemented, thereby improving the display characteristic when moving pictures are displayed and also reducing the factors for deteriorating the visibility due to, for example, false outlines.

The data signal may be a signal having an analog value obtained by inputting the first digital data.

Typically, the "main period" can be considered as a period from when a certain scanning line is selected to when the scanning line is subsequently selected. Alternatively, the "main period" may be a period required for completing the grayscale, i.e., one frame.

In the electro-optical apparatus according to the seventeenth invention, the signal level is a current level or a voltage level to be supplied to the electro-optical devices.

With this configuration, advantages similar to those of the electro-optical apparatus set forth in any one of the eleventh through sixteenth inventions can be obtained.

(Eighteenth Invention)

In order to achieve the above-described object, in an electronic system according to an eighteenth invention, the electro-optical apparatus set forth in any one of the eleventh through sixteenth inventions is implemented.

With this configuration, advantages similar to those of the electro-optical apparatus set forth in any one of the eleventh through sixteenth inventions can be obtained.

(Nineteenth Invention)

In order to achieve the above-described object, a control method for electronic devices according to a nineteenth invention is a control method for electronic devices for generating a control signal based on a digital signal so as to control the electronic devices by the generated control signal.

The control method for electronic devices includes: a first current-value setting step of setting a current value of the control signal in each first period; and a second current-value setting step of setting the current value of the control signal in each second period, which is different from the first period.

(Twentieth Invention)

In a control method for electronic devices according to a twentieth invention based on the control method for electronic devices according to the nineteenth invention, the second period is shorter than the first period, the first current-value setting step sets the current value of the control signal in each first period based on part of digital data forming the digital signal, and the second current-value setting step sets the current value of the control signal in each second period based on the remaining data other than the part of the digital data used by the first current-value setting step for the portion set by the first current-value setting step based on the same digital data of the control signal.

(Twenty-First Invention)

In a control method for electronic devices according to a twenty-first invention based on the control method for electronic devices according to the twentieth invention, upper bits of the digital data are assigned to the part of the data, and lower bits of the digital data are assigned to the remaining data.

(Twenty-Second Invention)

A control method for electronic devices according to a twenty-second invention is a control method for electronic devices for converting n items of digital data (n is an integer of two or greater) into a control electric signal to be supplied to electronic devices within a predetermined period so as to output the control electronic signal.

The control method includes a sub-period setting step of generating a signal for setting the length of a sub period, which is provided in the predetermined period, for outputting a sub electronic signal based on m items of digital data (m is an integer of one or greater) of n items of digital data.

In the sub period, the sub electric signal is output as the control electric signal.

(Twenty-Third Invention)

In a control method for electronic devices according to a twenty-third invention based on the control method for electronic devices according to the twenty-second invention, the sub electric signal is equivalent to an electric signal obtained by adding an addition electric signal to a reference electric signal or a processed electric signal obtained by processing the electric signal in the sub period, and the reference electric signal is an electric signal based on p items of digital data (p is an integer of one or greater) of the remaining data obtained by subtracting m items of digital data from n items of digital data used for setting the length of the sub period, and is not dependent on m items of digital data at least in the sub period.

(Twenty-Fourth Invention)

A driving method for an electro-optical apparatus according to a twenty-fourth invention is a driving method for an electro-optical apparatus which includes a plurality of scanning lines, a plurality of data lines, and a plurality of pixel circuits. In this driving method, a drive period from when a scanning signal is supplied to a pixel circuit set, which consists of the plurality of pixel circuits provided corresponding to each of the plurality of scanning lines, to when a subsequent scanning signal is supplied to the pixel circuit set includes: a first sub period in which the scanning signal is supplied to the pixel circuit set via the corresponding scanning line of the plurality of scanning lines, and a data signal is supplied to the pixel circuit set via the corresponding data line of the plurality of data lines; at least one second sub period in which a plurality of electro-optical devices contained in the pixel circuit set are set to a luminance level corresponding to the data signal; and a third sub period in which the luminance level of the plurality of electro-optical devices is set to be substantially 0. The third sub period for the pixel circuit set starts and ends at the same time as the other pixel circuit sets.

With this configuration, for example, the moving-picture characteristics can be improved.

In the above-described driving method for an electro-optical apparatus, at least one second sub period of the pixel circuit set may preferably be started at a time different from a time at which the second sub period is started for at least one of the other pixel circuit sets.

BRIEF DESCRIPTION OF THE DRAWINGS

FIG. 9 is a graph indicating a change in the luminance level of the pixel circuit 200 in accordance with the value of digital data In.

REFERENCE NUMERALS

Figure 1:
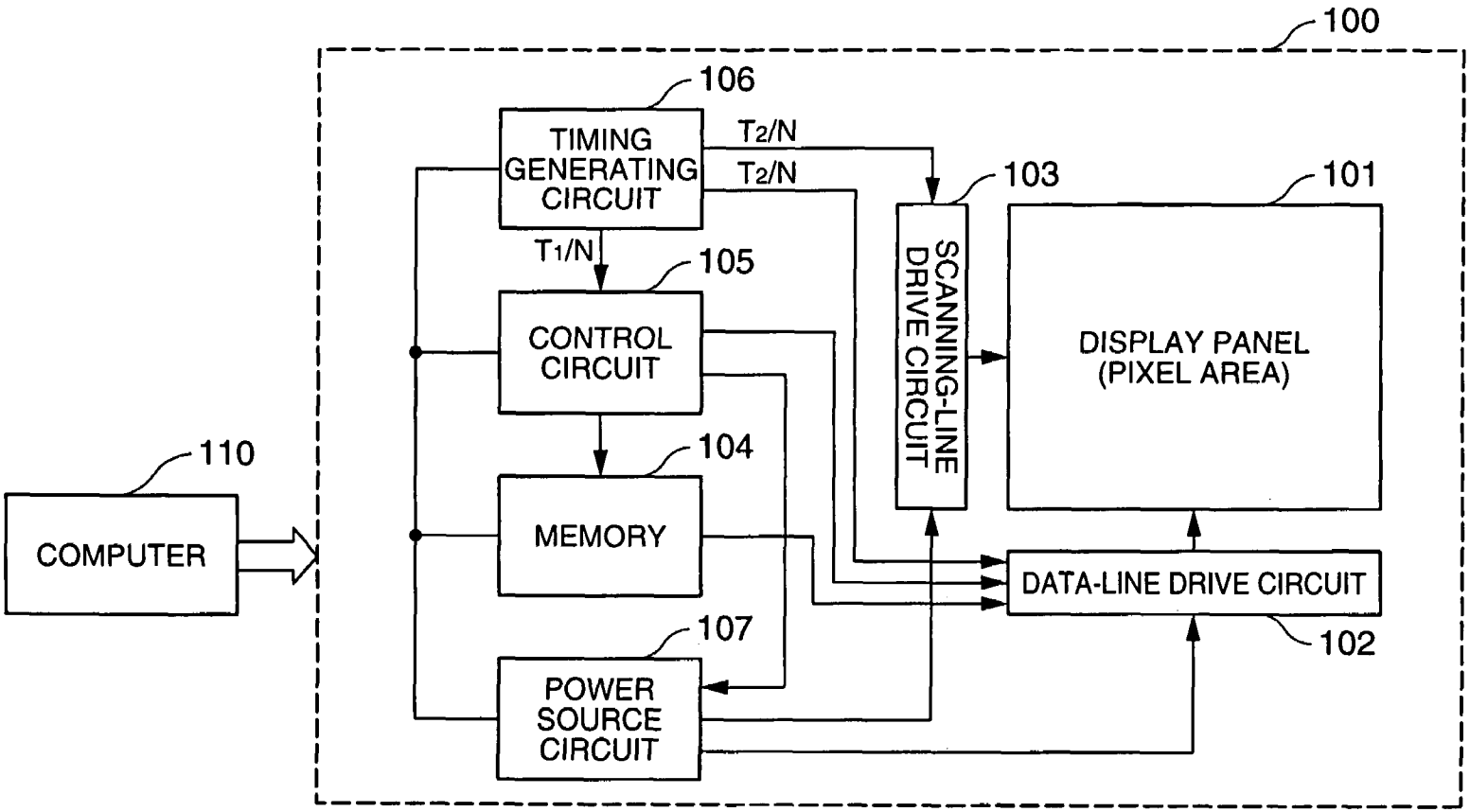
FIG. 1 is a block diagram illustrating the circuit configuration of an electro-optical apparatus 100 according to an embodiment of the present invention.

21 to 28 driving transistors
31 constant-voltage generating transistor
32 driving transistor
41 to 48 resistor transistors
51 resistor transistor
52 resistor transistor
71, 72 transistors
73 driving transistor
81 to 88 switching transistors
100 electro-optical apparatus
101 display panel
102 data-line drive circuit
103 scanning-line drive circuit
104 memory
105 control circuit
106 timing generating circuit
107 power source circuit
110 computer
200 pixel circuit
211 to 214 transistors
220 organic EL devices
230 retaining capacitor
300 single-line driver
301 signal input line
302 output signal line (data line)
303 first common gate line
304 second common gate line
310 D/A converter
320 offset-current generating circuit
400 gate-voltage generating circuit
401 first wiring pattern
402 second wiring pattern
500 data conversion circuit
1000 personal computer
1020 keyboard
1040 main unit
1060 display unit
2000 cellular telephone
2020 operation button
2040 mouthpiece
2060 earpiece
2080 display panel
3000 digital still camera
3020 casing
3040 display panel
3060 light receiving unit

3080 shutter button
3100 circuit substrate
3120 video signal output terminal
3140 input/output terminal
4300 television monitor
4400 personal computer

EMBODIMENTS

First Embodiment

A first embodiment is described below with reference to the drawings. FIGS. 1 through 9 illustrate a control circuit for electronic devices, an electronic circuit, an electro-optical apparatus, a semiconductor integrated circuit device, an electronic system, and a control method for electronic devices according to the first embodiment of the present invention.

In this embodiment, by applying the control circuit for electronic devices, the electronic circuit, the electro-optical apparatus, the semiconductor integrated circuit device, the electronic system, and the control method for electronic devices of the present invention, as shown in FIG. 1, a display panel 101 in which light emitting devices, such as organic EL devices, are disposed in a matrix is driven based on digital data supplied from a computer 110.

The configuration of this embodiment is first described with reference to FIG. 1. FIG. 1 is a block diagram illustrating the circuit configuration of an electro-optical apparatus 100 according to the first embodiment of the present invention.

The electro-optical apparatus 100 includes, as shown in FIG. 1, the display panel 101 (also referred to as a "pixel area") in which light emitting devices are disposed in a matrix, a data-line drive circuit 102 for driving data lines of the display panel 101, a scanning-line drive circuit 103 (also referred to as a "gate driver") for driving scanning lines of the display panel 101, a memory 104 for storing display data supplied from the computer 110, a timing generating circuit 106 for supplying a reference operation signal to the other elements, a power source circuit 107, and a control circuit 105 for controlling the individual elements of the electro-optical apparatus 100.

The elements 101 through 107 of the electro-optical apparatus 100 may be formed of independent components (for example, one-chip semiconductor integrated circuit devices), or part of or all the elements 101 through 107 may be integrated into one component. For example, the data-line drive circuit 102 and the scanning-line drive circuit 103 may be integrated into the display panel 101. Part of or all the elements 102 through 106 may be formed of a programmable chip, and the functions thereof may be implemented by a software program written into the IC chip.

Figure 2:
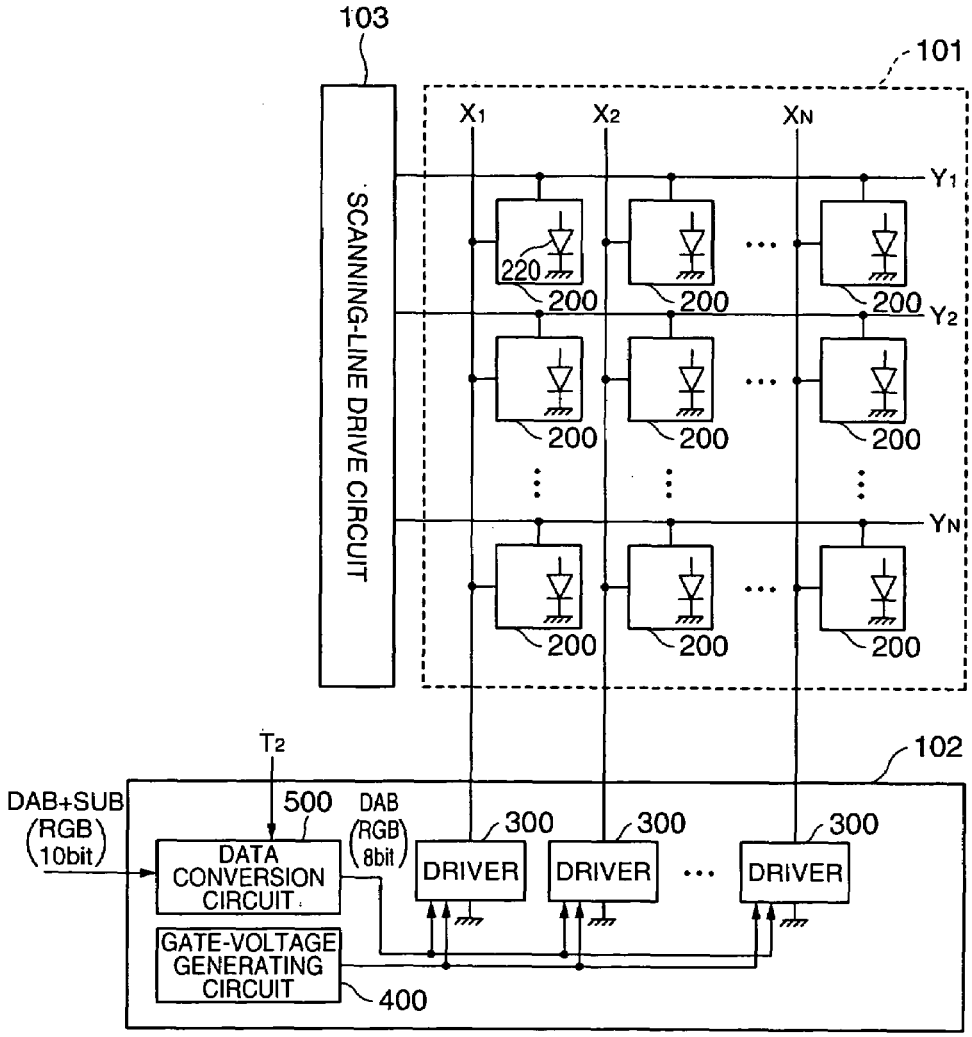
FIG. 2 illustrates the internal configuration of a display panel 101 and a data-line drive circuit 102.

The internal configuration of the display panel 101 and the data-line drive circuit 102 is now described in detail with reference to FIG. 2. FIG. 2 illustrates the internal configuration of the display panel 101 and the data-line drive circuit 102.

The display panel 101 has a plurality of pixel circuits 200 disposed in a matrix as shown in FIG. 2, each pixel circuit 200 having an organic EL device 220. A plurality of data lines $X_m$ (m=1 to M) extending in the column direction and a plurality of scanning lines $Y_n$ (n=1 to N) extending in the row direction are respectively connected to the matrix of the pixel circuits 200. The data lines are also referred to as "source lines", and the scanning lines are also referred to as "gate lines". In this embodiment, the pixel circuits 200 are also referred to as "unit circuits" or "pixels". Generally, the transistors in the pixel circuits 200 are formed of TFTs.

The scanning-line drive circuit 103 selects a group of pixel circuits 200 for one line by selectively driving one of the scanning lines $Y_n$.

The data-line drive circuit 102 is formed of a plurality of single-line drivers 300 for respectively driving the corresponding data lines $X_m$, a gate-voltage generating circuit 400 for generating a gate voltage, and a data conversion circuit 500 for converting display data supplied from the control circuit 105.

The gate-voltage generating circuit 400 supplies a gate control signal having a predetermined voltage to the single-line drivers 300. Details of the internal configuration of the gate-voltage generating circuit 400 are described below.

The single-line drivers 300 supply data signals to the pixel circuits 200 via the corresponding data lines $X_m$. When the internal state (described below) of the pixel circuit 200 is set according to this data signal, the value of a current to flow in the organic EL device 220 is controlled. As a result, the light-emitting grayscale of the organic EL device 220 is controlled. Details of the internal configuration of the single-line drivers 300 are given below.

The data conversion circuit 500 operates according to a timing signal from the timing generating circuit 106, and converts a 10-bit digital signal supplied from the control circuit 105 as display data into an 8-bit digital signal. Details of the internal configuration of the data conversion circuit 500 are given below.

The control circuit 105 converts, as shown in FIG. 1, display data indicating the display state of the display panel 101 into matrix data indicating the light-emission grayscale of each organic EL device 220. The matrix data includes a scanning-line drive signal for sequentially selecting a group of pixel circuits 200 for one line, and a data-line drive signal indicating the level of a data line signal to be supplied to the organic EL devices 200 of the selected group of pixel circuits 200. The scanning-line drive signal and the data-line drive signal are supplied to the scanning-line drive circuit 103 and the data-line drive circuit 102, respectively. The control circuit 105 controls the driving timing of the scanning lines and the data lines.

Figure 3:
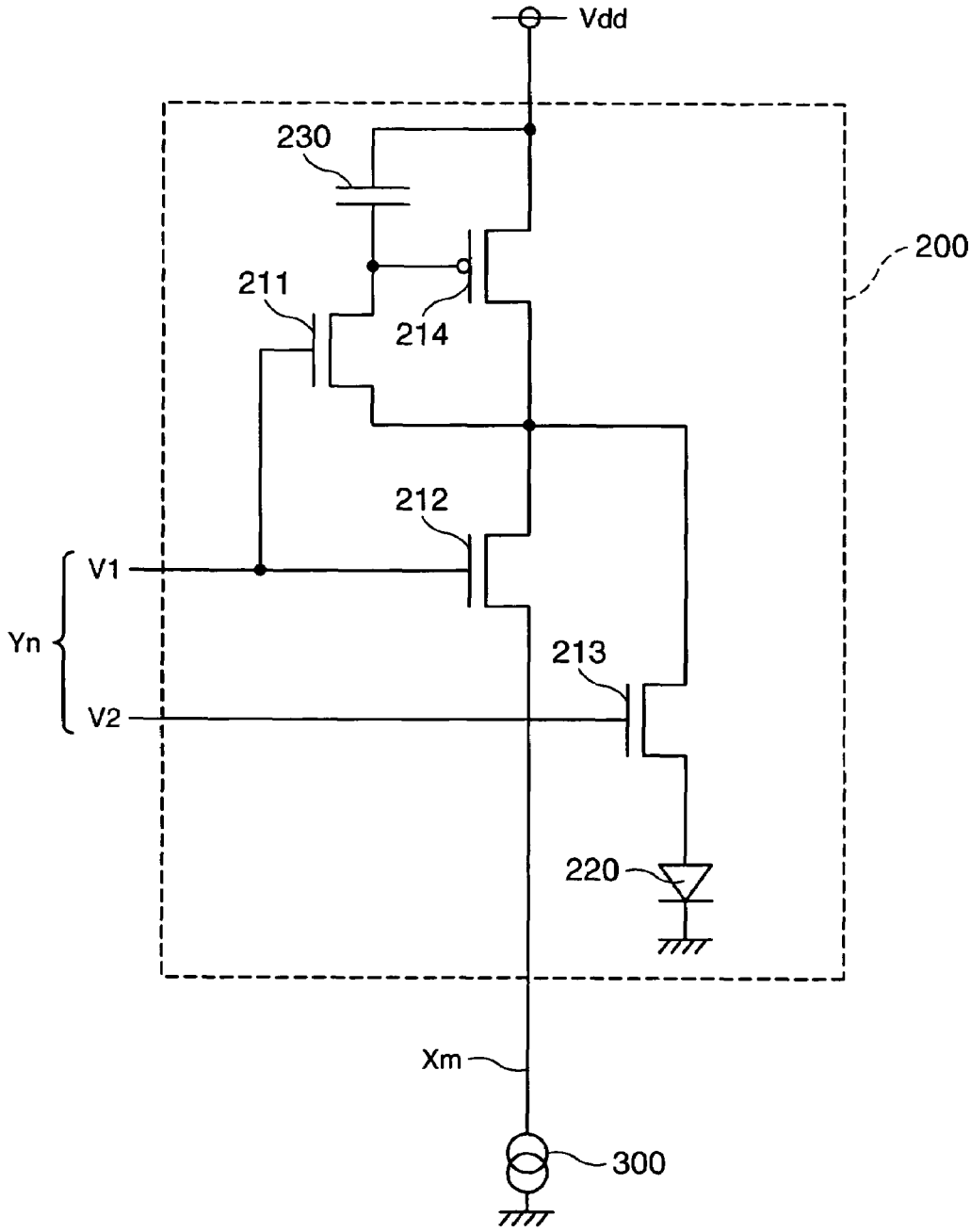
FIG. 3 illustrates the internal configuration of a pixel circuit 200.

Details of the internal configuration of the pixel circuit 200 are discussed below with reference to FIG. 3. FIG. 3 illustrates the internal structure of the pixel circuit 200.

The pixel circuit 200 is a circuit disposed at the intersection of the m-th data line and the n-th scanning line $Y_n$. The scanning line $Y_n$ includes two sub-scanning lines V1 and V2.

The pixel circuit 200 is, as shown in FIG. 3, a current program circuit for adjusting the grayscale of the organic EL device 220 according to the value of a current flowing in the data line $X_m$. More specifically, the pixel circuit 200 is provided with, not only the organic EL device 220, but also four transistors 211 through 214 and a retaining capacitor 230 (also referred to as a "retaining condenser" or a "storage capacitor"). The retaining capacitor 230 retains electric charges in accordance with a data signal supplied via the data line $X_m$ so as to adjust the light-emission grayscale of the organic EL device 220. In other words, the retaining capacitor 230 retains the voltage in accordance with the current flowing in the data line $X_m$. The first through third transistors 211 through 213 are n-channel FETS, and the fourth transistor 214 is a p-channel FET. Since the organic EL device 220 is a current-flowing (current-driving) light emitting device, as in a photodiode, it is indicated by the sign of a diode.

The source of the first transistor 211 is connected to the drain of the second transistor 212, the drain of the third transistor 213, and the drain of the fourth transistor 214. The drain of the first transistor 211 is connected to the gate of the fourth transistor 214. The retaining capacitor 230 is connected between the source and the gate of the fourth transistor 214. The source of the fourth transistor 214 is also connected to a power source potential $V_{dd}$.

The source of the second transistor 212 is connected to the single-line driver 300 (FIG. 2) via the data line $X_m$. The organic EL device 220 is connected between the source of the third transistor 213 and a ground potential.

Both the gates of the first and second transistors 211 and 212 are connected to the first sub-scanning line V1. The gate of the third transistor 213 is connected to the second sub-scanning line V2.

The first and second transistors 211 and 212 are switching transistors used for storing electric charges in the retaining capacitor 230. The third transistor 213 is a switching transistor, which is maintained to be ON during the light emission period of the organic EL device 220. The fourth transistor 214 is a driving transistor for controlling the value of a current flowing in the organic EL device 220. The current value of the fourth transistor 214 is controlled by the amount of electric charges (the amount of stored electric charges) retained in the retaining capacitor 230.

Figure 4:
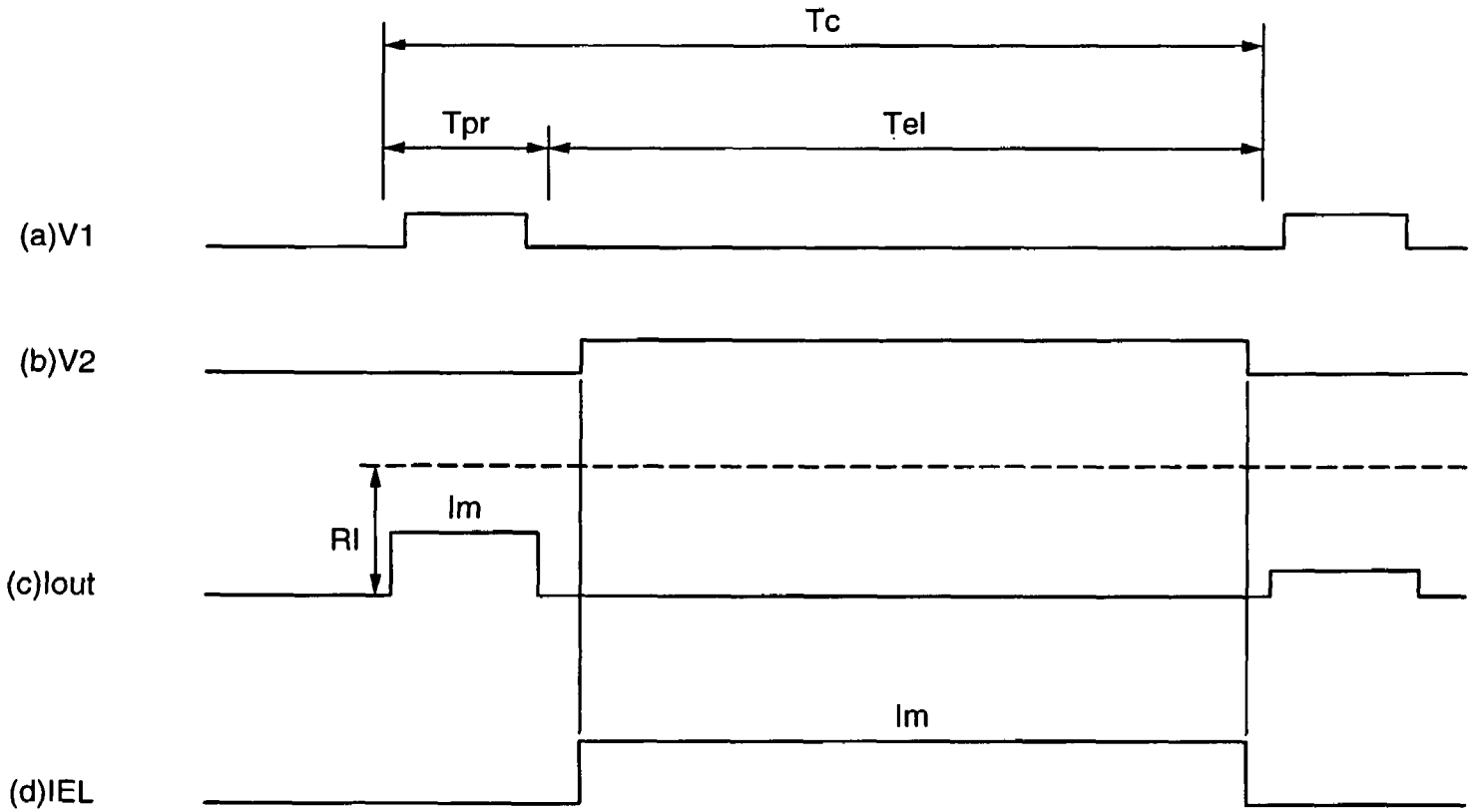
FIG. 4 is a timing chart illustrating the operation of the pixel circuit 200.

The operation of the pixel circuit 200 is described in detail below with reference to FIG. 4. FIG. 4 is a timing chart of the operation of the pixel circuit 200. In FIG. 4, the voltage of the first sub-scanning line V1 (hereinafter also referred to as the "first gate signal V1"), the voltage of the second sub-scanning line V2 (hereinafter also referred to as the "second gate signal V2"), the current value $I_{out}$ of the data line $X_m$ (also referred to as the "data signal $I_{out}$") and the current value $I_{BL}$ flowing in the organic EL device 220 are shown.

The driving cycle $T_c$ is divided into a programming period $T_{pr}$ and a light emission period $T_{el}$.

The "driving cycle $T_c$" is a cycle during which the light-emission grayscales of all the organic EL devices 220 in the display panel 101 are updated one time, and is equal to a so-called "frame period". The grayscales are updated for each line of a group of pixel circuits 200, and the gray scales of groups of pixel circuits 200 for N lines are sequentially updated during the driving cycle $T_c$. For example, when the grayscales of all the pixel circuits are updated at 30 [Hz], the driving cycle $T_c$ is about 33 [ms].

The programming period $T_{pr}$ is a period for setting the light-emission grayscales of the organic EL devices 220 in the pixel circuits 200. In this embodiment, the setting of the grayscales in the pixel circuits 200 is referred to as "programming". For example, when the driving cycle $T_c$ is about 33 [ms] and when the total number N of scanning lines $Y_n$ is 480, the programming period $T_{pr}$ is about 69 [μs] (=33 [ms]/480) or smaller.

In the programming period $T_{pr}$, the second gate signal V2 is set to be the low level, and the third transistor 213 is maintained to be OFF (closed). Then, the first gate signal V1 is set to be the high level, and the first and second transistors 211 and 212 are changed to be ON (opened) while causing the current value $I_m$ corresponding to the light-emission grayscale to flow in the data line $X_m$. In this case, the single-line driver 300 (FIG. 2) of the data line $X_m$ serves as a constant-current source for causing a constant-current value $I_m$ corresponding to the light-emission grayscale to flow. As shown in FIG. 4(*c*), the current value $I_m$ is set to be a value corresponding to the light-emission grayscale of the organic EL device 220 within the range RI of predetermined current values.

In the retaining capacitor 230, electric charges in accordance with the current value $I_m$ flowing in the fourth transistor 214 (driving transistor) is retained. As a result, a voltage stored in the retaining capacitor 230 is applied across the source and the gate of the fourth transistor 214. In this embodiment, the current value $I_m$ of the data signal used for programming is referred to as the "programming current value $I_m$".

Upon completion of the programming, the scanning-line drive circuit 103 sets the first gate signal V1 to the low level, and turns OFF the first and second transistors 211 and 212, and the data-line drive circuit 102 discontinues the data signal $I_{out}$.

In the light-emission period $T_{el}$, the second gate signal V2 is set to the high level, and the third transistor 213 is turned ON while the first gate signal V1 is maintained at the low level and the first and second transistors 211 and 212 are kept in the OFF state.

Since the voltage corresponding to the programming current value $I_m$ has been stored in the retaining capacitor 230, a current that is almost equivalent to the programming current value $I_m$ flows in the fourth transistor 214. Accordingly, a current that is almost equivalent to the programming current $I_m$ also flows in the organic EL device 220, causing the organic EL device 220 to emit light of grayscale in accordance with the current value $I_m$. As described above, in the pixel circuit 200 of the type to which the voltage of the retaining capacitor 230 (that is, electric charges) is written by the current value $I_m$ is referred to as a "current program circuit".

The timing generating circuit 106 outputs a timing signal REQ_A of the same cycle $T_1$ as the programming period $T_{pr}$ to the control circuit 105, and outputs a timing signal REQ_T of a cycle $T_2$, which is ¼ the cycle $T_1$, to the data-line drive circuit 102. Accordingly, the control circuit 105 operates in the cycle $T_1$, and the data-line drive circuit 102 operates in the cycle $T_2$, which is ¼ the cycle $T_1$.

Figure 5:
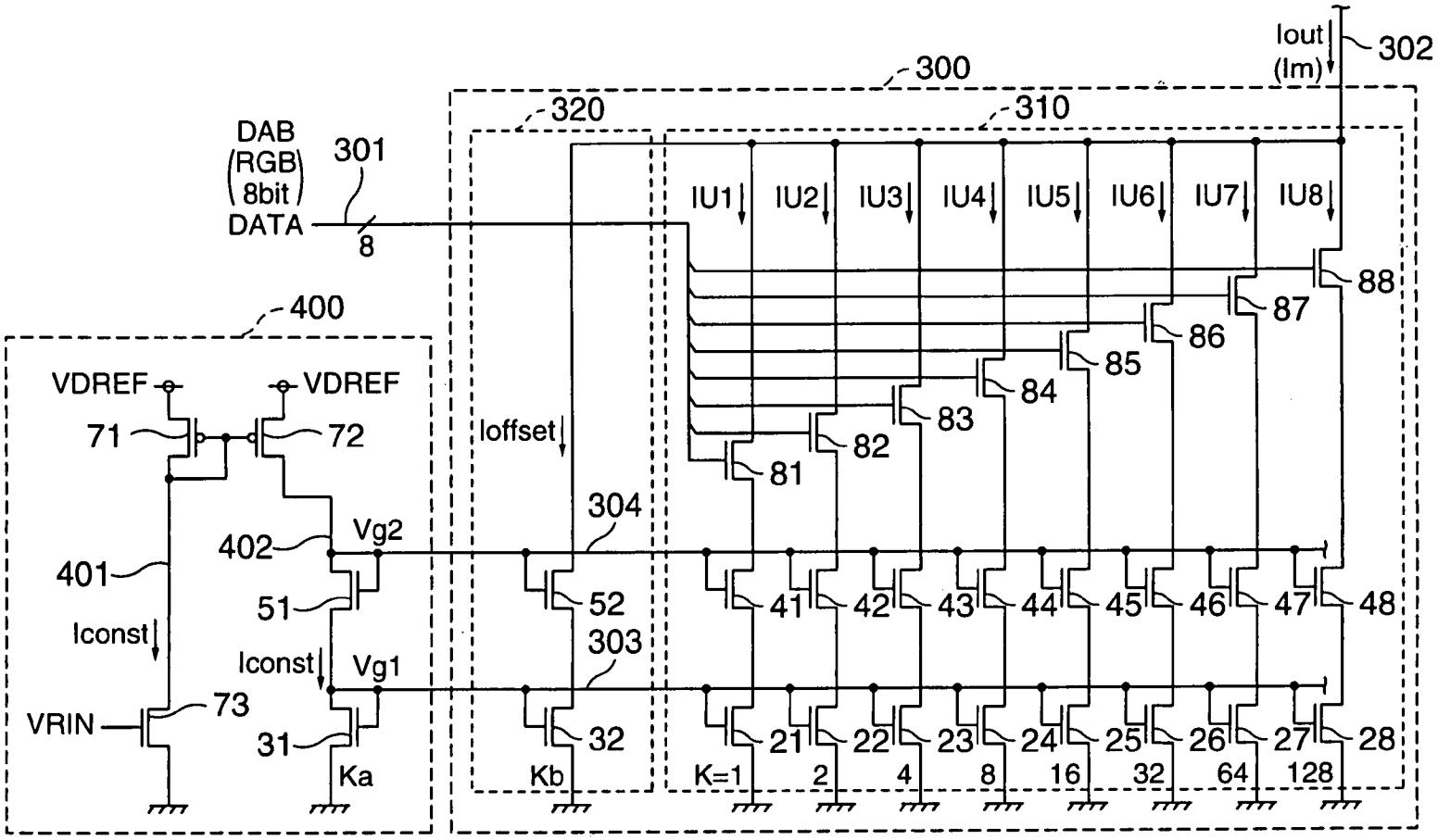
FIG. 5 is a circuit diagram illustrating the internal configuration of a single-line driver 300 and a gate-voltage generating circuit 400.

Details of the internal configuration of the single-line driver 300 and the gate-voltage generating circuit 400 are described below with reference to FIG. 5. FIG. 5 is a circuit diagram illustrating the internal configuration of the single-line driver 300 and the gate-voltage generating circuit 400.

The single-line driver 300 includes, as shown in FIG. 5, an 8-bit D/A converter 310 and an offset-current generating circuit 320.

The D/A converter 310 is formed of eight current lines IU1 through IU8 connected in parallel with each other. In the first current line 1U1, a switching transistor 81, a resistor transistor 41, which serves as one type of resistor device, a driving transistor 21, which serves as a constant current source for causing a predetermined current to flow, are connected in series between the data line 302 and a ground potential. The other current lines IU2 through IU8 are configured similarly to the current line IU1. These three types of transistors 81 through 88, 41 through 48, and 21 through 28 are all n-channel FETs in the example of FIG. 5. The gates of the eight driving transistors 21 through 28 are connected to a first common gate line 303. The gates of the eight resistor transistors 41 through 48 are connected to a second common gate line 304. A digital signal indicating each bit of 8-bit grayscale data DATA supplied from the data conversion circuit 500 (FIG. 1) is input into the gate of each of the eight switching transistors 81 through 88 via a signal input line 301.

The ratio K of the gain coefficients β of the eight driving transistors 21 through 28 is set to 1:2:4:8:16:32:64:128. That is, the relative value K of the gain coefficient β of the n-th (n=1 to N) driving transistor is set to $2^{n-1}$. As is well known, the gain coefficient β is defined as $\beta=K\beta_0=(\mu C_0 W/L)$, where K is the relative value, $\beta_0$ is a predetermined constant, μ is the carrier mobility, $C_0$ is the gate capacitance, W is the channel width, and L is the channel length. The number N of driving transistors is an integer of 2 or greater. It should be noted that the number N of driving transistors is irrelevant to the number of scanning lines $Y_n$.

The eight driving transistors 21 through 28 serve as constant current sources. Since the current driving capacity of transistors is proportional to the gain coefficient β, the ratio of the current driving capacities of the eight driving transistors 21 through 28 is 1:2:4:8:16:32:64:128. In other words, the relative value K of the gain coefficient of each of the driving transistors 21 through 28 is set to a value corresponding to the level of each bit of the grayscale data DATA.

The current driving capacities of the resistor transistors 41 through 48 are generally set to be higher than those of the corresponding driving transistors 21 through 28. Accordingly, the current driving capacities of the current lines IU1 through IU8 are determined by the driving transistors 21 through 28. The resistor transistors 41 through 48 serve as noise filters for eliminating noise of the current values.

In the offset-current generating circuit 320, a resistor transistor 52 and a driving transistor 32 are connected in series between the data line 302 and a ground potential. The gate of the driving transistor 32 is connected to the first common gate line 303, and the gate of the resistor transistor 52 is connected to the second common gate line 304. The relative value of the gain coefficient β of the driving transistor 32 is Kb. In the offset-current generating circuit 320, a switching transistor is not disposed between the driving transistor 32 and the data line 302, which is different from the current lines of the D/A converter 310.

A current line $I_{offset}$ of the offset-current generating circuit 320 is connected in parallel with the eight current lines IU1 through IU8 of the D/A converter 310. Accordingly, the total of the currents flowing in the nine current lines $I_{offset}$, and IU1 through IU8 is sent to the data line 302 as the programming current. That is, the single-line driver 310 is a current-addition-type current generating circuit. The signs $I_{offset}$ and IU1 through IU8 indicating the corresponding current lines are hereinafter also used as the signs indicating currents flowing in the corresponding current lines.

The gate-voltage generating circuit 400 includes a current mirror circuit formed of two transistors 71 and 72. The gates of the two transistors 71 and 72 are connected to each other, and the gate and the drain of the first transistor 71 are also connected to each other. One of the terminals (sources) of the two transistors 71 and 72 is connected to a source potential VDREF for the gate-voltage generating circuit 400. A driving transistor 73 is connected in series to a first wiring pattern 401 disposed between the other terminal (drain) of the first transistor 71 and a ground potential. A control signal VRIN having a predetermined voltage level is input into the gate of the driving transistor 73 from the control circuit 105. A resistor transistor 51 and a constant-voltage generating transistor 31 (also referred to as the "control electrode signal generating transistor") are connected in series to a second wiring pattern 402 disposed between the other terminal (drain) of the second transistor 72 and a ground potential. The relative value of the gain coefficient β of the constant-voltage generating transistor 31 is Ka.

The gate and the drain of the constant-voltage generating transistor 31 are connected to each other, and are connected to the first common gate line 303 of the single-line driver 300. The gate and the drain of the resistor transistor 51 are also connected to each other, and are connected to the second common gate line 304 of the single-line driver 300.

In the example shown in FIG. 5, the two transistors 71 and 72 forming a current mirror circuit are p-channel FETs, and the other transistors are n-channel FETs.

When the control signal VRIN having a predetermined voltage level is input into the gate of the driving transistor 73 of the gate-voltage generating circuit 400, a constant reference current $I_{const}$ in accordance with the voltage level of the control signal VRIN is generated in the first wiring pattern 401. Since the two transistors 71 and 72 form a current mirror circuit, the same reference current $I_{const}$ also flows in the second wiring pattern 402. However, the currents flowing in the two wiring patterns 401 and 402 do not have to be the same, and, generally, the first and second transistors 71 and 72 are configured so that a current in proportion to the reference current $I_{const}$ of the first wiring pattern 401 flows in the second wiring pattern 402.

Predetermined gate voltages Vg1 and Vg2 corresponding to the current $I_{const}$ are respectively generated between the gates and the drains of the two transistors 31 and 51 in the second wiring pattern 402. The first gate voltage Vg1 is applied to the gates of the nine driving transistors 32 and 21 through 28 in the single-line driver 300 via the first common gate line 303. The second gate voltage Vg2 is applied to the gates of the nine resistor transistors 52 and 41 through 48 via the second common gate line 304.

The current driving capacities of the current lines $I_{offset}$ and IU1 through IU8 are determined by the gain coefficients β of the driving transistors 32 and 21 through 28 and the apply voltage. Accordingly, in each of the current lines $I_{offset}$ and IU1 through IU8 of the single-line driver 300, the current having a value proportional to the relative value K of the gain coefficient β of the corresponding driving transistor flows according to the gate voltage Vg1. In this case, when 8-bit grayscale data DATA is supplied from the control circuit 105 via the signal input line 301, the eight switching transistors 81 through 88 are controlled to be ON or OFF according to the bit values of the grayscale data DATA. As a result, the programming current $I_m$ having a current value corresponding to the value of the grayscale data DATA is output to the data line 302.

The single-line driver 300 has the offset-current generating circuit 320. Accordingly, the value of the grayscale data DATA and the programming current $I_m$ are not exactly proportional to each other, i.e., a proportional relationship by passing the origin is not established, and there is an offset between the grayscale data and the programming current. By providing such an offset, the flexibility to set the range of the programming current is increased, and thus, the programming current value can be easily set to a desirable range.

Figure 6:
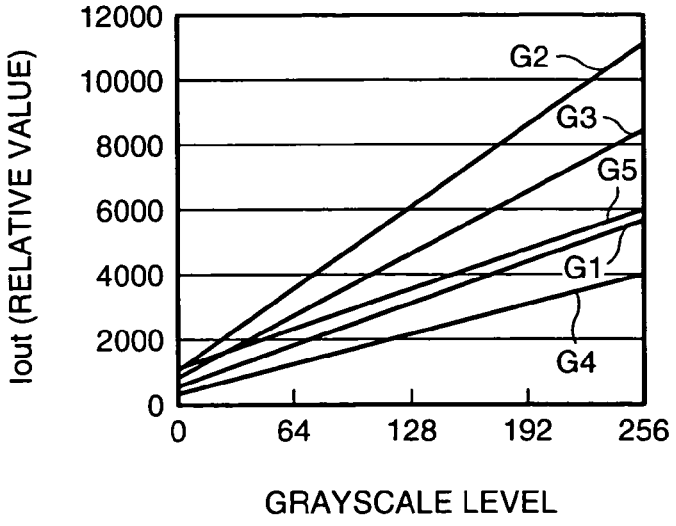
FIG. 6 illustrate example 1 through example 5 indicating the relationships between the output current $I_{out}$ of the data-line drive circuit 102 and the values of grayscale data DATA (grayscale levels).

FIG. 6 illustrates example 1 through example 5 indicating the relationships between the output current $I_m$ of the data-line drive circuit 102 and the grayscale data DATA (grayscale levels). In the table of FIG. 6(*a*), standard example 1, and examples 2 through 5, which are obtained by varying the following four parameters are shown:

(1) VRIN: voltage of the gate signal of the driving transistor 73 of the gate-voltage generating circuit 400;

(2) VDREF: source voltage of the current mirror circuit of the gate-voltage generating circuit 400;

(3) Ka: relative value of the gain coefficient β of the constant-voltage generating transistor 31 of the gate-voltage generating circuit 400; and (4) Kb: relative value of the gain coefficient β of the driving transistor 32 of the offset-current generating circuit 320.

FIG. 6(*b*) is a graph obtained by plotting the relationships shown in FIG. 6(*a*). In "standard" example 1, each parameter is set to a predetermined standard value. In example 2, only the voltage VRIN of the driving transistor 73 is set to be higher than that of "standard" example 1. In example 3, only the source voltage VDREF of the current mirror circuit is set to be higher than that of "standard" example 1. In example 4, only the relative value Ka of the gain coefficient β of the constant-voltage generating transistor 31 is set to be greater than that of "standard" example 1. In example 5, only the relative value Kb of the gain coefficient β of the driving transistor 32 is set to be greater than that of "standard" example 1.

The table and the graph show that the value of the output current $I_{out}$ changes according to each parameter VRIN; VDREF, Ka and Kb. Accordingly, by changing the value of one or more parameters, the range of the current value used for controlling the light-emission grayscale can be changed. The values of these parameters VRIN, VDREF, Ka, and Kb can be set by adjusting the designing values of the corresponding circuit portions. In the circuit configuration shown in FIG. 5, any of the four parameters VRIN, VDREF, Ka, and Kb influences the range of the output current $I_{out}$. Accordingly, the flexibility to set the range of the output current $I_{out}$ is increased, and a desired range can be easily set.

The output current $I_{out}$ is proportional to the reference current $I_{const}$ in the gate-voltage generating circuit 400. Accordingly, the reference current $I_{const}$ is determined by the range of the current value required for the output current $I_{out}$ (i.e., the programming current $I_m$). In this case, if the reference current $I_{const}$ is set to the two extreme values of the range of the required current value for the output current $I_{out}$, a small variation (error) of the reference current $I_{const}$ may disadvantageously generate a large variation (error) of the output current $I_{out}$ according to the performance of the circuit components. Thus, in order to reduce the error of the output current $I_{out}$, the reference current $I_{const}$ is preferably set to the value around the middle of the maximum value and the minimum value of the range of the output current $I_{out}$. The expression "around the middle of the maximum value and the minimum value" means the range of about ±10% of the average value (i.e., the center value) of the maximum value and the minimum value.

Figure 7:
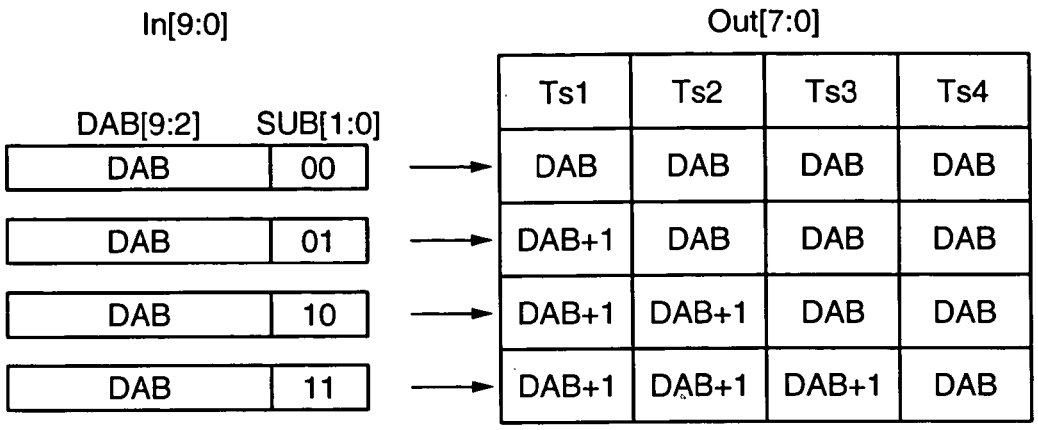
FIG. 7 illustrates conversion rules of a data conversion circuit 500.
Figure 8:
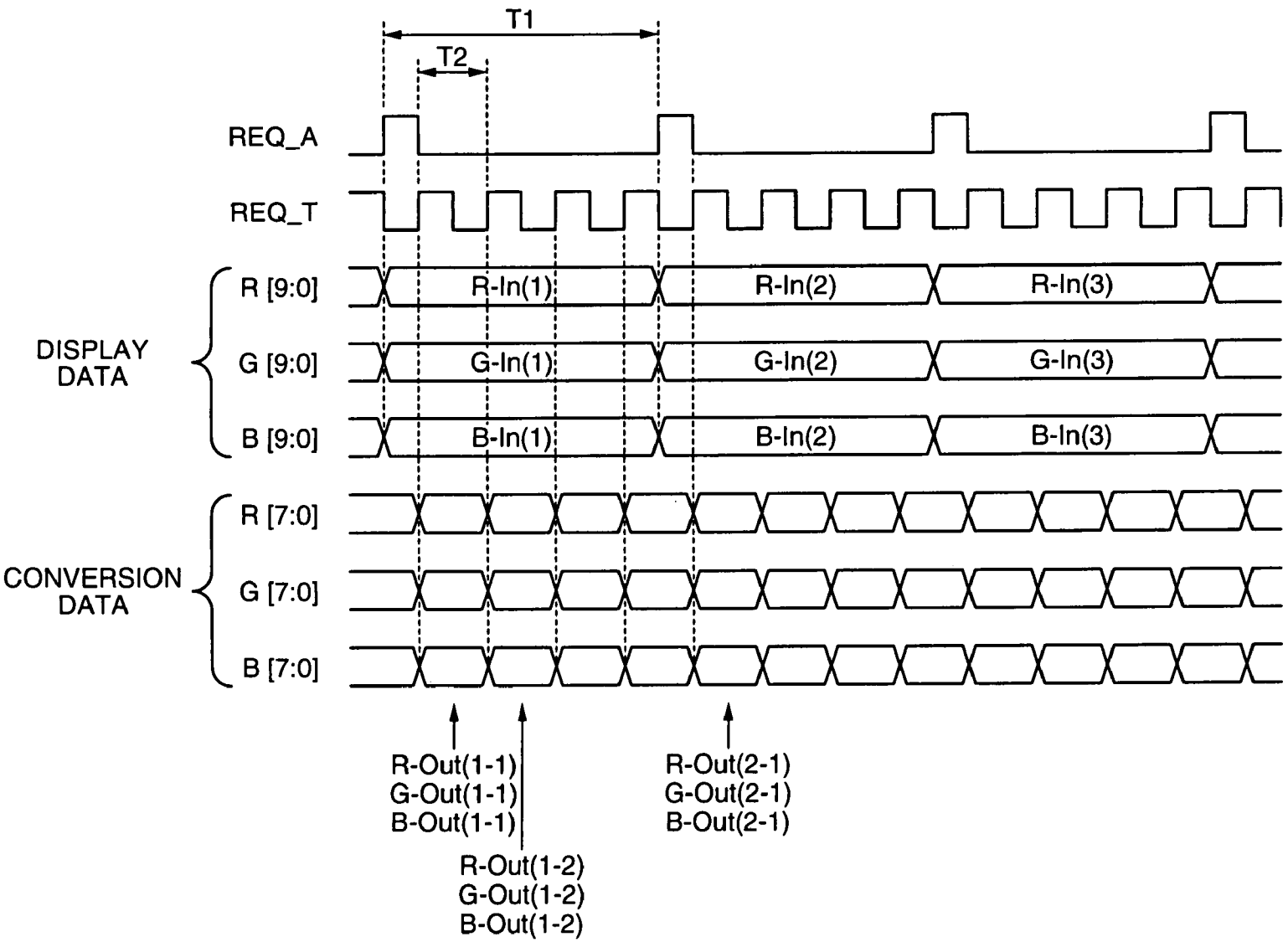
FIG. 8 is a time chart illustrating the operation of the data conversion circuit 500.

Details of the configuration of the data conversion circuit 500 are described in detail below with reference to FIGS. 7 and 8. FIG. 7 illustrates conversion rules of the data conversion circuit 500. FIG. 8 is a time chart of the operation of the data conversion circuit 500. For representation, in FIGS. 7 and 8, only one line in the Y direction is taken as an example (equivalent to the operation when N is 1).

As shown in FIGS. 7 and 8, the data conversion circuit 500 receives 10-bit digital data In from the memory 104 as the display data in every cycle $T_1$, and separates the input digital data In into upper 8-bit first digital data DAB and lower 2-bit second digital data SUB. Then, the data conversion circuit 500 outputs 8-bit digital data Out to the single-line driver 300 in every cycle $T_2$ based on the value of the digital data SUB.

In FIG. 8, REQ_A indicates a timing signal of the cycle $T_1$, REQ_T designates a timing signal of the cycle $T_2$, R[9:0] represents 10-bit digital data In indicating the light-emission grayscale of a red color, G[9:0] represents 10-bit digital data In indicating the light-emission grayscale of a green color, and B[9:0] represents 10-bit digital data In indicating the light-emission grayscale of a blue color. R[9:2] designates 8-bit digital data Out indicating the light-emission grayscale of a red color, G[9:2] designates 8-bit digital data Out indicating the light-emission grayscale of a green color, and B[9:2] designates 8-bit digital data Out indicating the light-emission grayscale of a blue color.

More specifically, when the value of the digital data SUB is "00", as indicated in the first line of the table at the right side of FIG. 7, the digital data DAB is output to the single-line driver 300 as the digital data Out until the end of cycle $T_1$, since the cycle $T_1$ is four times longer than the cycle $T_2$. This conversion output is performed for each element of RGB data. Accordingly, the current $I_{out}$ expressed by equation (1), on the whole, is output from the single-line driver 300 in the cycle $T_1$. In equation (1), k is a predetermined coefficient, DAB is a decimal value of the digital data DAB.

$$I_{out}=K\times DAB\times 4/4 \tag{1}$$

When the value of the digital data SUB is "01", as indicated in the second line of the table at the right side of FIG. 7, data obtained by adding "1" to the digital data DAB is output to the single-line driver 300 as the digital data Out from the start of the cycle $T_1$ to the first portion $T_{s1}$ of the cycle $T_2$, and outputs the digital data DAB to the single-line driver 300 as the digital data Out until the end of the remaining portion of the cycle $T_1$. This conversion output is performed for each element of the RGB data. Accordingly, the current $I_{out}$ expressed by equation (2), on the whole, is output from the single-line driver 300 in the cycle $T_1$.

$$I_{out}=K\times\{(DAB+1)+DAB\times 3\}/4 \tag{2}$$

When the value of the digital data SUB is "10", as indicated in the third line of the table at the right side of FIG. 7, data obtained by adding "1" to the digital data DAB is output to the single-line driver 300 as the digital data Out from the start of the cycle $T_1$ to the second portion $T_{s2}$ of the cycle $T_2$, and outputs the digital data DAB to the single-line driver 300 as the digital data Out until the end of the remaining portion of the cycle $T_1$. This conversion output is performed for each element of the RGB data. Accordingly, the current $I_{out}$ expressed by equation (3), on the whole, is output from the single-line driver 300 in the cycle $T_1$.

$$I_{out}=K\times\{(DAB+1)\times 2+DAB\times 2\}/4 \tag{3}$$

When the value of the digital data SUB is "11", as indicated in the fourth line of the table at the right side of FIG. 7, data obtained by adding "1" to the digital data DAB is output to the single-line driver 300 as the digital data Out from the start of the cycle $T_1$ to the third portion $T_{s3}$ of the cycle $T_2$, and outputs the digital data DAB to the single-line driver 300 as the digital data Out until the end of the remaining portion of the cycle $T_1$. This conversion output is performed for each element of the RGB data. Accordingly, the current $I_{out}$ expressed by equation (4), on the whole, is output from the single-line driver 300 in the cycle $T_1$.

$$I_{out}=K\times\{(DAB+1)\times 3+DAB\}/4 \tag{4}$$

Figure 9:
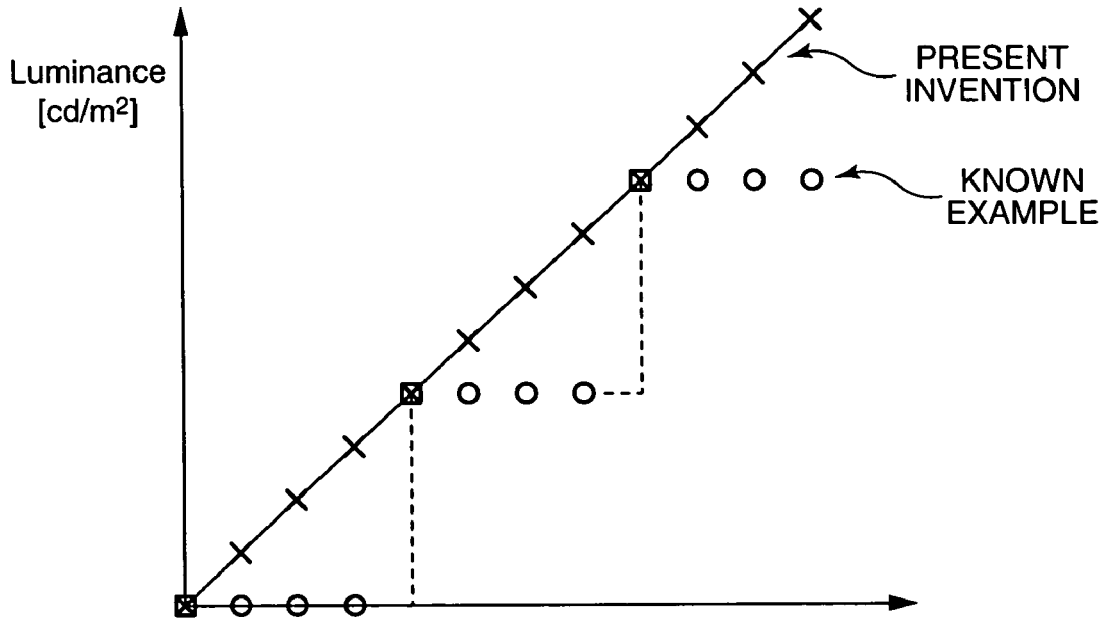

The operation of this embodiment is described below with reference to FIG. 9. FIG. 9 is a graph illustrating a change in the luminance level of the pixel circuit 200 according to the value of the digital data In.

For causing the pixel circuits 200 to emit light in the display panel 101, the control circuit 105 operates in every cycle $T_1/N$ (when the number of scanning lines is N) according to the timing signal REQ_A from the timing generating circuit 106 so as to control the data-line drive circuit 102 and the scanning-line drive circuit 103.

The control circuit 105 first performs control of the scanning-line drive circuit 103. Accordingly, the scanning-line drive circuit 103 drives the scanning line $Y_n$ to select one line of the pixel matrix in the display panel 101. Thus, a group of pixel circuits 200 disposed in the row direction of the pixel matrix are selected.

The control circuit 105 performs controls of the data-line drive circuit 102 independently of the control of the scanning-line drive circuit 103. For the control of the data-line drive circuit 102, every 10 bits of display data is read from the memory 104 in every $T_1/N$ according to a timing signal REQ_A supplied from the timing generating circuit 106, and a digital signal indicating the read display data is input into the data-line drive circuit 102.

In the data-line drive circuit 102, upon receiving the digital signal, the data conversion circuit 500 divides the digital data In input in every $T_1/N$ into the upper 8-bit digital data DAB and the lower 2-bit digital data SUB, and outputs the 8-bit digital data Out to the single-line driver 300 in every cycle $T_2/N$ based on the value of the digital data SUB.

When the value of the digital data SUB is "00", the digital data DAB is output to the single-line driver 300 as the digital data Out until the end of the cycle $T_1$. Then, the current $I_{out}$ corresponding to the value of the digital data Out is output from the single-line driver 300, and the control signal corresponding to the current $I_{out}$ is input into a group of pixel circuits 200 disposed in the column direction of the pixel matrix. Accordingly, the pixel circuits 200 program the control signal in the programming cycle $T_{pr}$, which is the same cycle as the cycle $T_1/N$, thereby causing the pixel circuits 200 belonging to the group of pixel circuits 200 selected by the scanning-line drive circuit 103 and also belonging to the group of pixel circuits 200 into which the control signal is input by the data-line drive circuit 102 to emit light with a luminance level according to the current $I_{out}$ expressed by the above-described equation (1).

When the value of the digital data SUB is "01", data obtained by adding "1" to the digital data DAB is output to the single-line driver 300 as the digital data Out from the start of the cycle $T_1$ to the first portion $T_{s1}$ of the cycle $T_2$, and outputs the digital data DAB to the single-line driver 300 as the digital data Out until the end of the remaining portion of the cycle $T_1$. Then, the current $I_{out}$ corresponding to the value of the digital data Out is output from the single-line driver 300, and the control signal corresponding to the current $I_{out}$ is input into a group of pixel circuits 200 disposed in the column direction of the pixel matrix. Accordingly, the pixel circuits 200 program the control signal in the programming cycle $T_{pr}$, which is the same cycle as the cycle $T_2/N$, thereby causing the pixel circuits 200 belonging to the group of pixel circuits 200 selected by the scanning-line drive circuit 103 and also belonging to the group of pixel circuits 200 into which the control signal is input by the data-line drive circuit 102 to emit light with a luminance level according to the current $I_{out}$ expressed by the above-described equation (2).

When the value of the digital data SUB is "10", data obtained by adding "1" to the digital data DAB is output to the single-line driver 300 as the digital data Out from the start of the cycle $T_1$ to the second portion $T_{s2}$ of the cycle $T_2$, and outputs the digital data DAB to the single-line driver 300 as the digital data Out until the end of the remaining portion of the cycle $T_1$. Then, the current $I_{out}$ corresponding to the value of the digital data Out is output from the single-line driver 300, and the control signal corresponding to the current $I_{out}$ is input into a group of pixel circuits 200 disposed in the column direction of the pixel matrix. Accordingly, the pixel circuits 200 program the control signal in the programming cycle $T_{pr}$, which is the same cycle as the cycle $T_2/N$, thereby causing the pixel circuits 200 belonging to the group of pixel circuits 200 selected by the scanning-line drive circuit 103 and also belonging to the group of pixel circuits 200 into which the control signal is input by the data-line drive circuit 102 to emit light with a luminance level according to the current $I_{out}$ expressed by the above-described equation (3).

When the value of the digital data SUB is "11", data obtained by adding "1" to the digital data DAB is output to the single-line driver 300 as the digital data Out from the start of the cycle $T_1$ to the third portion $T_{s3}$ of the cycle $T_2$, and outputs the digital data DAB to the single-line driver 300 as the digital data Out until the end of the remaining portion of the cycle $T_1$. Then, the current $I_{out}$ corresponding to the value of the digital data Out is output from the single-line driver 300, and the control signal corresponding to the current $I_{out}$ is input into a group of pixel circuits 200 disposed in the column direction of the pixel matrix. Accordingly, the pixel circuits 200 program the control signal in the programming cycle $T_{pr}$, which is the same cycle as the cycle $T_2/N$, thereby causing the pixel circuits 200 belonging to the group of pixel circuits 200 selected by the scanning-line drive circuit 103 and also belonging to the group of pixel circuits 200 into which the control signal is input by the data-line drive circuit 102 to emit light with a luminance level according to the current $I_{out}$ expressed by the above-described equation (4).

In FIG. 9, a comparison between this embodiment and an analog method when the pixel circuits 200 are driven by using the 8-bit D/A converter 310 is shown. According to the analog method, when the control circuit 105 supplies 10-bit digital data In to the data-line drive circuit 102, the upper or lower 2-bit digital data is neglected, and D/A conversion is performed based on the remaining 8-bit digital data. Accordingly, as indicated by white-dot plotting and broken lines in FIG. 9, the luminance level can be set only for every group of four items of data (2-bit data) in a stepwise manner. In contrast, according to this embodiment, when the control circuit 105 supplies 10-bit digital data to the data-line drive circuit 102, D/A conversion is performed based on the upper 8-bit digital data DAB. This is the same as the analog method. However, based on the lower 2-bit digital data SUB, pulse-width control is performed in every cycle $T_2$ for the data which is D/A-converted based on the same digital data In of the control signal. Accordingly, as indicated by crossed plotting and solid lines in FIG. 9, different luminance levels can be set for the individual data.

Thus, by using the same D/A converter 310, the luminance level of the pixel circuit 200 can be adjusted with precision four times higher than the analog method. Conversely, to implement the same level of precision, the D/A converter 310 can be formed of 6 bits, thereby decreasing the circuit scale.

Upon comparison of this embodiment with a known digital method, when the operation frequency of the data-line drive circuit 102 is set to the same frequency, the luminance level of the pixel circuit 200 can be adjusted with higher precision than a known digital method since the precision is complemented by D/A conversion in addition to pulse-width control. Conversely, to implement the same level of precision, it is not necessary to set the frequency of the cycle $T_2/N$ to be as high as the known digital method for the same reason.

As described above, in this embodiment, the data-line drive circuit 102 controls the current value of the control signal in every cycle $T_1/N$ based on the upper 8-bit digital data DAB of the digital data In, and performs pulse-width control in every cycle $T_{2/N}$ based on the lower 2-bit digital data SUB for the data which is D/A-converted based on the same digital data of the control signal.

Accordingly, the pixel circuit 200 can be controlled relatively with high precision without small-capacitance transistors as the single-line driver 300. Also, it is not necessary to set the frequency of the cycle $T_2$ to be as high as that when the same level of precision is implemented by a digital method. It is thus possible to inhibit a variation in the luminance-so as to control the luminance levels of pixels with relatively high precision.

In the first exemplary embodiment, the pixel circuit 200 corresponds to the electronic device of the first, fourth, nineteenth, or twenty-first aspects, or corresponds to the light emitting device of the eleventh, thirteenth, or sixteenth aspects. The cycle $T_1$ corresponds to the first period of the first, third, eleventh, twelfth, fourteenth, nineteenth, or twentieth aspects, and the cycle $T_2$ corresponds to the second period of the first, third, eleventh, twelfth, fourteenth, nineteenth, or twentieth aspects. The data conversion circuit 500 and the single-line driver 300 correspond to the first current-value setting device of the second, third, eleventh, or twelfth aspects, or corresponds to the second current-value setting device of the second, third, eleventh, or twelfth aspects. D/A conversion performed by the data conversion circuit 500 and the single-line driver 300 corresponds to the first current-value setting step of the nineteenth or twentieth aspects.

In the first embodiment, pulse-width control performed by the data conversion circuit 500 and the single-line driver 300 corresponds to the second current-value setting step of the nineteenth or twentieth invention.

In the first embodiment, the pixel circuit 200 corresponds to the electronic device of the fifth invention, and the data conversion circuit 500 and the single-line driver 300 correspond to the sub-period setting means of the fifth invention.

The upper 2 bits may be set to the second digital data SUB, and the lower 8 bits may be set to the first digital data DAB. In other words, the number of period-setting data may be larger than that of luminance-level setting data. With this arrangement, many sub periods can be set, and the time resolution can be improved.

By suitably setting the number of period-setting data and the number of luminance-level setting data, priority can be given to one of the resolution in the time domain or the resolution in the luminance level.

Second Embodiment

Figure 10:
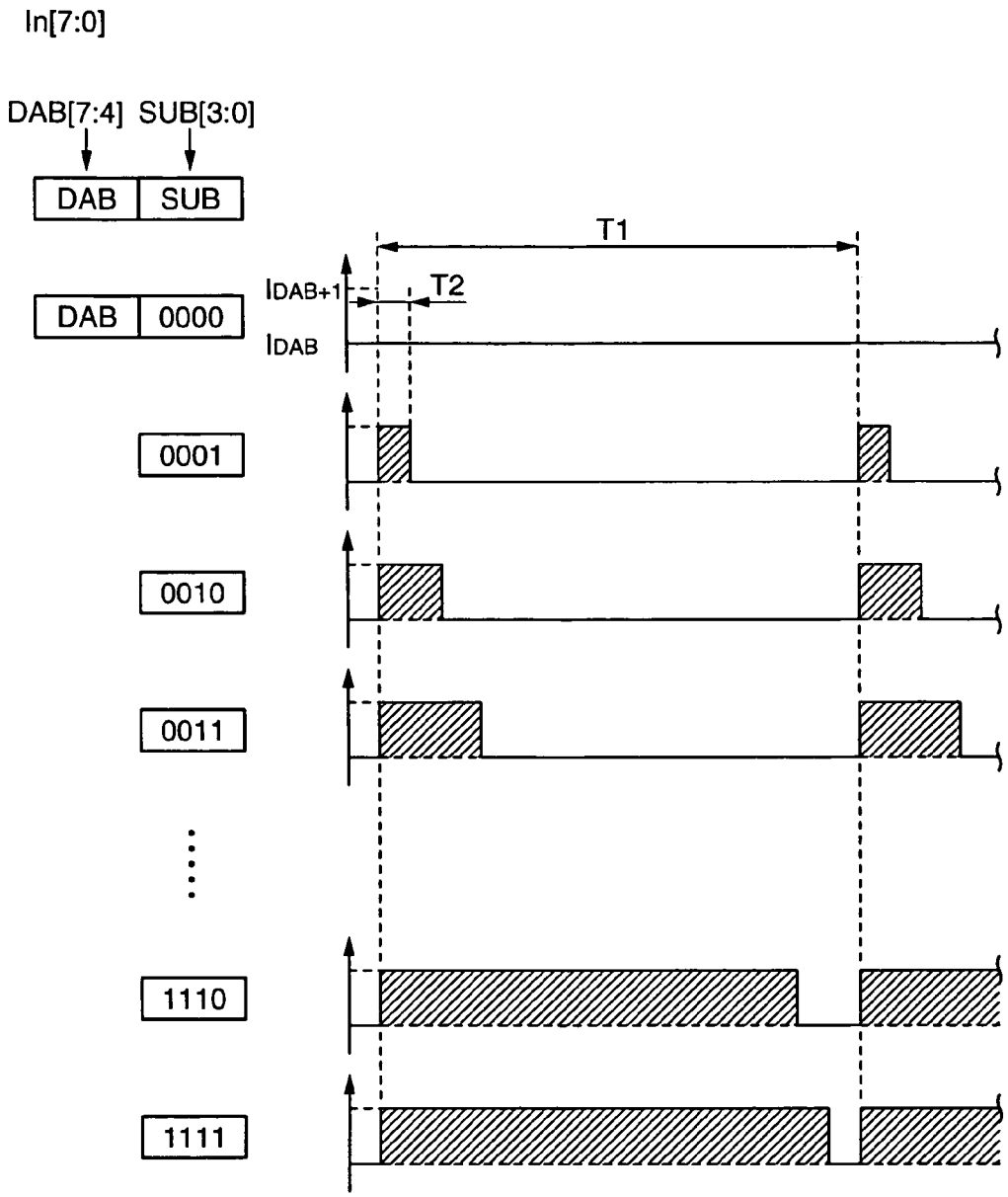
FIG. 10 is a time chart illustrating an output of digital data Out in a cycle $T_1$.

A second embodiment of the present invention is described below with reference to the drawings. FIG. 10 illustrates the second embodiment of the control circuit for electronic devices, the electronic circuit, the electro-optical apparatus, the semiconductor integrated circuit device, the electronic system, and the control method for electronic devices according to the present invention. Portions different from those of the first embodiment are described below, and the same portions as the first embodiment are indicated by like reference numerals and an explanation thereof is thus omitted.

In this embodiment, by applying the control circuit for electronic devices, the electronic circuit, the electro-optical apparatus, the semiconductor integrated circuit device, the electronic system, and the control method for electronic devices of the present invention, as shown in FIG. 1, the display panel 101 in which light emitting devices, such as organic EL devices, are disposed in a matrix is driven based on digital data supplied from the computer 110. The second embodiment is different from the first embodiment in the portion for performing pulse-width control of the cycle $T_2$.

The configuration of this embodiment is first described below with reference to FIG. 10. FIG. 10 is a time chart illustrating an output of digital data Out in the cycle $T_1$. For representation, only a certain line in the Y direction is shown in FIG. 10 (equivalent to the operation when N is 1). In FIG. 10, DAB indicates the value of the digital data DAB, and SUB indicates the value of the digital data SUB.

The timing generating circuit 106 outputs the timing signal REQ_A of the cycle $T_1$ to the control circuit 105, and outputs the timing signal REQ_T of the cycle $T_2$, which is 1/16 the cycle $T_1$ to the data-line drive circuit 102. Accordingly, the control circuit 105 operates in the cycle $T_1$, and the data-line drive circuit 102 operates in the cycle $T_2$, which is 1/16 the cycle $T_1$.

The single-line driver 300 has the 4-bit D/A converter 310 and the offset-current generating circuit 320.

As shown in FIG. 10, the data conversion circuit 500 receives 8-bit digital data In from the display circuit 105 in every cycle $T_1$ as the display data, and divides the received digital data In into upper 4-bit digital data DAB and lower 4-bit digital data SUB, and outputs 4-bit digital data Out to the single-line driver 300 in every cycle $T_2$ based on the value of the digital data SUB. More specifically, by considering the digital data SUB as numeric values from "0" to "15", since the cycle $T_1$ has a duration exactly 16 times longer than the cycle $T_2$, as shown in FIG. 10, data obtained by adding "1" to the digital data DAB is output to the single-line driver 300 as the digital data Out from the start of the cycle $T_1$ to the time calculated by multiplying the value of the digital data SUB by the cycle $T_2$, and then outputs the digital data DAB to the single line driver 300 as the digital data Out until the end of the remaining portion of the cycle $T_1$.

The operation of this embodiment is as follows.

For causing the pixel circuits 200 to emit light in the display panel 101, the control circuit 105 operates in every cycle $T_1/N$ (when the number of scanning lines is N) according to the timing signal REQ_A from the timing generating circuit 106 so as to control the data-line drive circuit 102 and the scanning-line drive circuit 103.

The control circuit 105 first performs control of the scanning-line drive circuit 103. Accordingly, the scanning-line drive circuit 103 drives the scanning line $Y_n$ to select one line of the pixel matrix in the display panel 101. Thus, a group of pixel circuits 200 disposed in the row direction of the pixel matrix are selected.

The control circuit 105 performs controls of the data-line drive circuit 102 independently of the control of the scanning-line drive circuit 103. For the control of the data-line drive circuit 102, every 8 bits of display data is read from the memory 104 in every $T_1/N$ according to a timing signal REQ_A supplied from the timing generating circuit 106, and a digital signal indicating the read display data is input into the data-line drive circuit 102.

In the data-line drive circuit 102, upon receiving the digital signal, the data conversion circuit 500 divides the digital data In input in every $T_1/N$ into upper 4-bit digital data DAB and lower 4-bit digital data SUB, and outputs the 4-bit digital data Out to the single-line driver 300 in every cycle $T_2/N$ based on the value of the digital data SUB.

More specifically, data obtained by adding "1" to the digital data DAB is output to the single-line driver 300 as the digital data Out from the start of the cycle $T_1/N$ to the time calculated by multiplying the value of the digital data SUB by the cycle $T_2/N$, and then, the digital data DAB is output to the single-line driver 300 as the digital data Out until the end of the remaining portion of the cycle $T_1/N$. Accordingly, the current $I_{out}$ corresponding to the digital data Out is output from the single-line driver 300, and the control signal of the current $I_{out}$, is input into a group of pixel circuits 200 disposed in the column direction of the pixel matrix. Accordingly, the pixel circuits 200 program the control signal in the programming cycle $T_{pr}$, which is the same cycle as the cycle $T_2/N$, thereby causing the pixel circuits 200 belonging to the group of pixel circuits 200 selected by the scanning-line drive circuit 103 and also belonging to the group of pixel circuits 200 into which the control signal is input by the data-line drive circuit 102 to emit light with a luminance level according to the value of the digital data In. That is, although the resolution of the D/A converter 310 is 4 bits, the luminance value of the pixel circuit 200 can be adjusted with 8-bit precision.

As described above, in this embodiment, 8-bit digital data In is input from the control circuit 105 as the display data in every cycle $T_1/N$, and the input digital data In is divided into upper 4-bit digital data DAB and lower 4-bit digital data SUB. Then, data obtained by adding "1" to the digital data DAB is output to the single-line driver 300 as the digital data Out from the start of the cycle $T_1/N$ to the time calculated by multiplying the value of the digital data SUB by the cycle $T_2/N$, and then, the digital data DAB is output to the single-line driver 300 as the digital data Out until the end of the remaining portion of the cycle $T_1/N$. With this arrangement, advantages similar to those of the first embodiment can be obtained.

In the second exemplary embodiment, the pixel circuit 200 corresponds to the electronic device of the first, fourth, nineteenth through twenty-first aspects, or corresponds to the light emitting device of the eleventh, thirteenth, or sixteenth aspects. The cycle $T_1$ corresponds to the first period of the first, third, eleventh, twelfth, fourteenth, nineteenth, or twentieth aspects, and the cycle $T_2$ corresponds to the second period of the first, third, eleventh, twelfth, fourteenth, nineteenth, or twentieth aspects. The data conversion circuit 500 and the single-line driver 300 correspond to the first current-value setting device of the second, third, eleventh, or twelfth aspects, or corresponds to the second current-value setting device of the second, third, eleventh, or twelfth aspects. D/A conversion performed by the data conversion circuit 500 and the single-line driver 300 corresponds to the first current-value setting step of the nineteenth or twentieth aspects.

In the second embodiment, pulse-width control performed by the data conversion circuit 500 and the single-line driver 300 corresponds to the second current-value setting step of the nineteenth or twentieth invention.

In the second embodiment, the pixel circuit 200 corresponds to the electronic device of the fifth invention, and the data conversion circuit 500 and the single-line driver 300 correspond to the sub-period setting means of the fifth invention.

Third Embodiment

Figure 11:
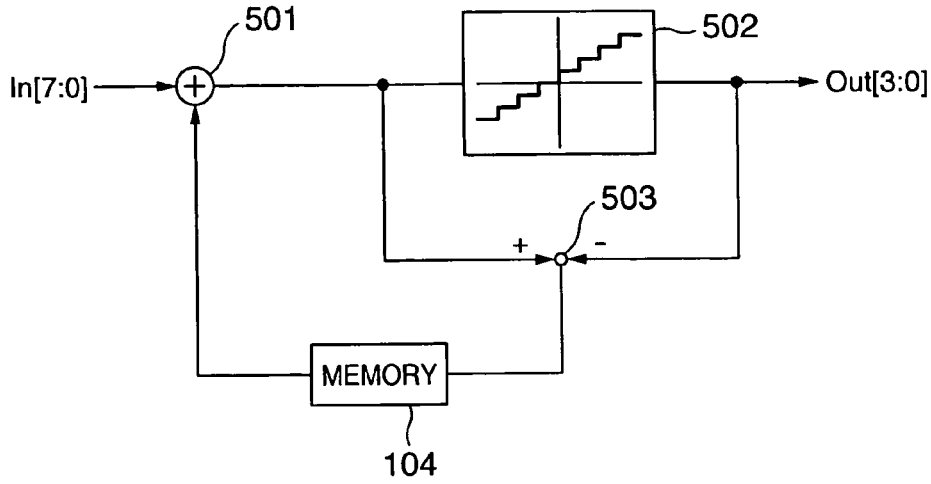
FIG. 11 is a block diagram illustrating the configuration of the data conversion circuit 500.
Figure 12:
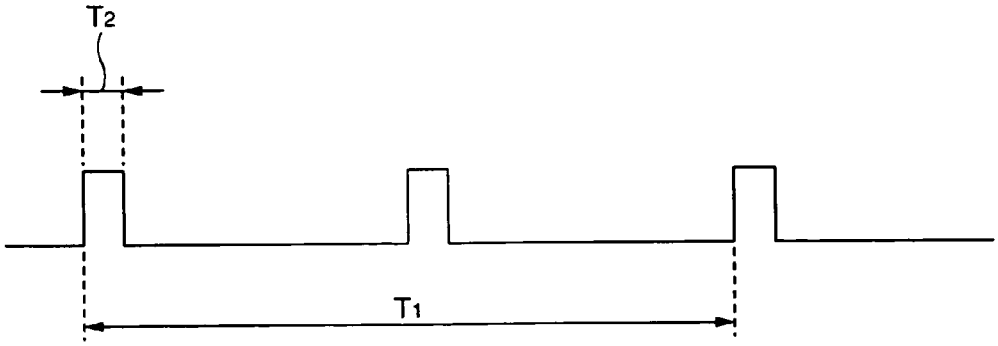
FIG. 12 is a time chart illustrating an output of the digital data Out in the cycle $T_1$.
Figure 13:
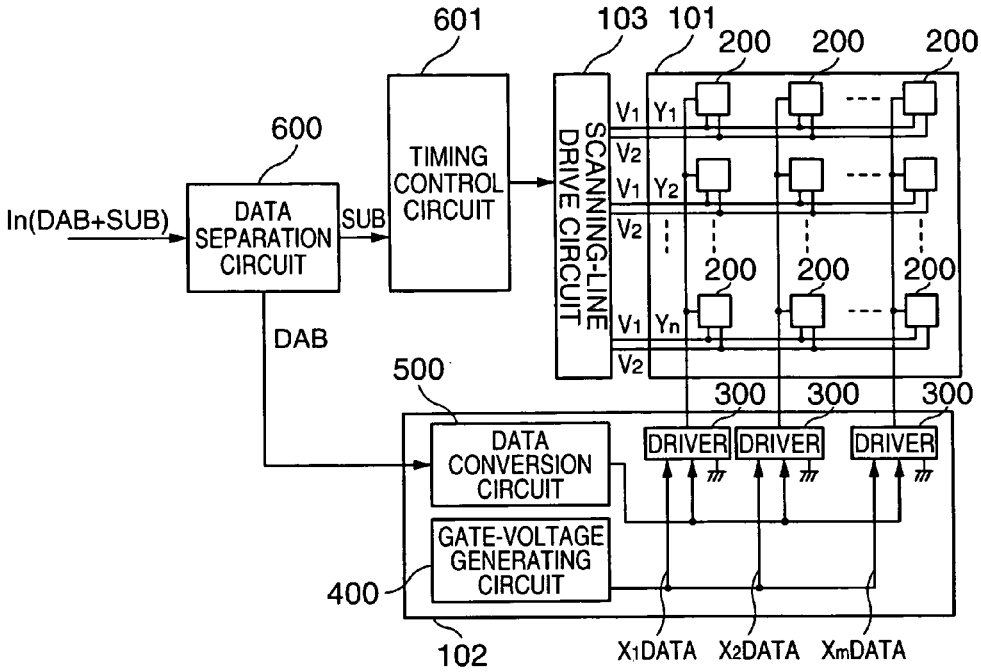
FIG. 13 illustrates the internal configuration of the display panel 101 and the data-line drive circuit 102.

A third embodiment of the present invention is described below with reference to the drawings. FIGS. 11 and 12 illustrate the third embodiment of the control circuit for electronic devices, the electronic circuit, the electro-optical apparatus, the semiconductor integrated circuit device, the electronic system, and the control method for electronic devices according to the present invention. Portions different from those of the first embodiment are described below, and the same portions as the first embodiment are indicated by like reference numerals and an explanation thereof is thus omitted.

In this embodiment, by applying the control circuit for electronic devices, the electronic circuit, the electro-optical apparatus, the semiconductor integrated circuit device, the electronic system, and the control method for electronic devices of the present invention, as shown in FIG. 1, the display panel 101 in which light emitting devices, such as organic EL devices, are disposed in a matrix is driven based on digital data supplied from the computer 110. The third embodiment is different from the first embodiment in the portion for performing pulse-width control of the cycle $T_2$.

The configuration of this embodiment is first described below with reference to FIGS. 11 and 12. FIG. 11 is a block diagram illustrating the configuration of the data conversion circuit 500. FIG. 12 is a time chart illustrating an output of digital data Out in the cycle $T_1$. For representation, only a certain line in the Y direction is shown in FIGS. 11 and 12 (equivalent to the operation when N is 1).

The timing generating circuit 106 outputs the timing signal REQ_A of the cycle $T_1$ to the control circuit 105, and outputs the timing signal REQ_T of the cycle $T_2$, which is 1/16 the cycle $T_1$, to the data-line drive circuit 102. Accordingly, the control circuit 105 operates in the cycle $T_1$, and the data-line drive circuit 102 operates in the cycle $T_2$, which is 1/16 the cycle T1.

The single-line driver 300 has the 4-bit D/A converter 310 and the offset-current generating circuit 320.

The data conversion circuit 500 includes, as shown in FIG. 11, an adder 501 for adding digital data In and the previous digital data Out in the memory 104, a calculator 502 for setting lower 4 bits of the digital data (8 bits), which is the addition result of the adder 501, to "0", and a subtractor 503 for subtracting the digital data (8 bits), which is the calculation result of the calculator 502, from the digital data, which is the addition result of the adder 501. The data conversion circuit 500 outputs the digital data (8 bits), which is the calculation result of the calculator 502, to the single-line driver 300 as the digital data Out, and also stores the digital data, which is the subtraction result of the subtractor 503, in the memory 104.

The data conversion circuit 500 operates as follows. In every cycle $T_1$, 8-bit digital data In is input from the control circuit 105 as the display data, and is divided into upper 4-bit digital data DAB and lower 4-bit digital data SUB. Then, the digital data SUB is added by the elements 501 through 503 in every cycle $T_2$, and if a carry occurs for the fourth bit, data obtained by adding "1" to the digital data DAB (added by a carry) is output to the single-line driver 300 as the digital data Out, and in other cases, the digital data DAB is output to the single-line driver 300 as the digital data Out.

For example, when the digital data SUB is "0001", data obtained by adding "1" to the digital data DAB is output only in the sixteenth portion $T_{s16}$ of the cycle $T_2$ of the cycle $T_1$. When the digital data SUB is "0010", data obtained by adding "1" to the digital data DAB is output only in the eighth and sixteenth portions $T_{s8}$ and $T_{s16}$ of the cycle $T_2$ of the cycle $T_1$. That is, data obtained by adding "1" to the digital data DAB is output discretely in the cycle $T_1$ rather than being continuously output from the start of the cycle $T_1$.

The operation of this embodiment is as follows.

For causing the pixel circuits 200 to emit light in the display panel 101, the control circuit 105 operates in every cycle $T_1$ according to the timing signal REQ_A from the timing generating circuit 106 so as to control the data-line drive circuit 102 and the scanning-line drive circuit 103.

The control circuit 105 first performs control of the scanning-line drive circuit 103. Accordingly, the scanning-line drive circuit 103 drives the scanning line $Y_n$ to select one line of the pixel matrix in the display panel 101. Thus, a group of pixel circuits 200 disposed in the row direction of the pixel matrix are selected.

The control circuit 105 performs controls of the data-line drive circuit 102 independently of the control of the scanning-line drive circuit 103. For the control of the data-line drive circuit 102, every 8 bits of display data is read from the memory 104 in every $T_1$ according to a timing signal REQ_A supplied from the timing generating circuit 106, and a digital signal indicating the read display data is input into the data-line drive circuit 102.

In the data-line drive circuit 102, upon receiving the digital signal, the data conversion circuit 500 divides the digital data In input in every $T_1$ into upper 4-bit digital data DAB and lower 4-bit digital data SUB, and outputs the 4-bit digital data Out to the single-line driver 300 in every cycle $T_2$ based on the value of the digital data SUB.

More specifically, the digital data SUB is added in every cycle $T_2$, and if a carry occurs for the fourth bit, data obtained by adding "1" to the digital data DAB is output to the single-line driver 300 as the digital data Out, and in other cases, the digital data DAB is output to the single-line driver 300 as the digital data Out. Accordingly, the current $I_{out}$ corresponding to the digital data Out is output from the single-line driver 300, and the control signal of the current $I_{out}$ is input into a group of pixel circuits 200 disposed in the column direction of the pixel matrix. Accordingly, the pixel circuits 200 program the control signal in the programming cycle $T_{pr}$, which is the same cycle as the cycle $T_1$, thereby causing the pixel circuits 200 belonging to the group of pixel circuits 200 selected by the scanning-line drive circuit 103 and also belonging to the group of pixel circuits 200 into which the control signal is input by the data-line drive circuit 102 to emit light with a luminance level according to the value of the digital data In. That is, although the resolution of the D/A converter 310 is 4 bits, the luminance value of the pixel circuit 200 can be adjusted with 8-bit precision.

As described above, in this embodiment, 8-bit digital data In is input from the control circuit 105 as the display data in every cycle $T_1$, and the input digital data In is divided into upper 4-bit digital data DAB and lower 4-bit digital data SUB. Then, the digital data SUB is added in every cycle $T_2$, and if a carry occurs for the fourth bit, data obtained by adding "1" to the digital data DAB is output to the single-line driver 300 as the digital data Out, and in other cases, the digital data DAB is output to the single-line driver 300 as the digital data Out. With this arrangement, advantages similar to those of the first embodiment can be obtained.

In the third exemplary embodiment, the pixel circuit 200 corresponds to the electronic device of the first, fourth, nineteenth through twenty-first aspects, or corresponds to the light-emitting device of the eleventh, thirteenth, or sixteenth aspects. The cycle $T_1$ corresponds to the first period of the first through third, eleventh, twelfth, fourteenth, nineteenth, or twentieth aspects, and the cycle $T_2$ corresponds to the second period of the first, third, eleventh, twelfth, fourteenth, nineteenth, or twentieth aspects. The data conversion circuit 500 and the single-line driver 300 correspond to the first current-value setting device of the second, third, eleventh, or twelfth aspects, or corresponds to the second current-value setting device of the second, third, eleventh, or twelfth aspects. D/A conversion performed by the data conversion circuit 500 and the single-line driver 300 corresponds to the first current-value setting step of the nineteenth or twentieth aspects.

In the third embodiment, pulse-width control performed by the data conversion circuit 500 and the single-line driver 300 corresponds to the second current-value setting step of the nineteenth or twentieth invention.

In the third embodiment, the pixel circuit 200 corresponds to the electronic device of the fifth invention, and the data conversion circuit 500 and the single-line driver 300 correspond to the sub-period setting means of the fifth invention.

Fourth Embodiment

A period control signal may be directly generated based on part of the digital data In.

For example, the digital data In is separated into first digital data DAB and second digital data SUB in a data separation circuit 600, and the first digital data DAB is input into the data conversion circuit 500. In this case, the data conversion circuit 500 may be provided with a function of changing the number of bits of the input first digital data DAB. Alternatively, a parallel signal may be converted into a serial signal in accordance with the transmission format of the data signal to the data line, and conversely, a serial signal may be converted into a parallel signal.

Meanwhile, the second digital data SUB is input into a timing control circuit 601. Based on this second digital data SUB, a period control signal is generated in the timing control circuit 601, and the second gate signal V2, which serves as the period control signal, is supplied to each pixel circuit via the scanning-line drive circuit 103.

Figure 14:
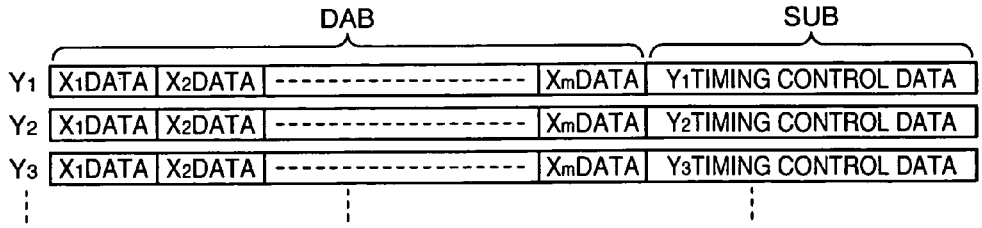
FIG. 14 illustrates an example of the configuration of the digital data.

The digital data In is formed of, as shown in FIG. 14, the first digital data DAB consisting of data corresponding to data signals $X_1$ through $X_m$ to be supplied to the data lines, and the second digital data SUB, which serves as the base for the timing control signal. As stated above, the first digital data DAB is supplied to the data-line drive circuit so as to generate data signals to be supplied to the data lines, and based on the second digital data SUB, a period control signal or a timing control signal for a light-emission period to be supplied via the scanning-line drive circuit is generated.

Figure 15:
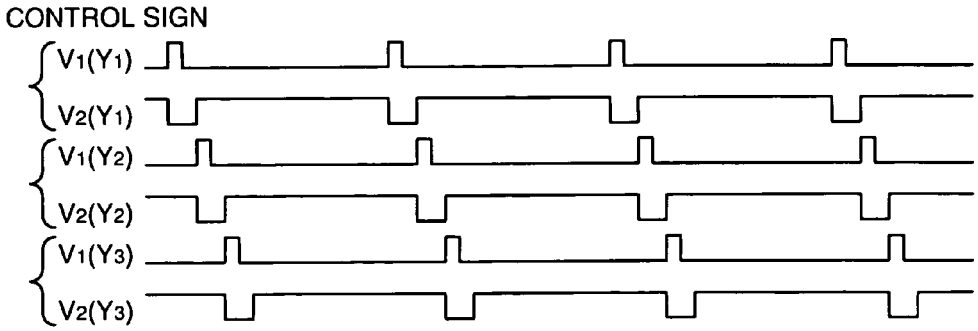
FIG. 15 illustrates timing charts of the control signals.

FIG. 15 illustrates a timing chart of the first gate signal V1 and the second gate signal V2 in the pixel circuit shown in FIG. 3. During the period in which a data signal is written by supplying the first gate signal V1 for switching ON the transistor 211 which controls the continuity with the data line and the transistor 212 which controls the continuity between the drain and the gate of the transistor 214, the second gate signal for switching OFF the transistor 213 which controls the continuity between the transistor 214 and the organic EL device 220 is supplied. Even when the supply of the first gate signal V1 for switching OFF the transistors 211 and 212 is started after the data signal has been written into the pixel circuit, the transistor 213 is maintained to be OFF for a while to prevent the supply of a current to the organic EL device 220. Thereafter, the second gate signal for switching ON the transistor 213 is supplied to electrically connect the organic EL device 220 and the transistor 214, thereby causing the organic EL device 220 to emit light with a luminance level in accordance with the data signal.

The first gate signal V1 for switching OFF the transistor 211 which controls the continuity with the data line and the transistor 212 which controls the continuity between the drain and the gate of the transistor 214 is supplied, and simultaneously, the Y counter of the timing control circuit 601 is reset. The second gate signal for switching ON the transistor 213 is supplied until the sub-period data which is set in the second digital data SUB becomes equal to the value of the Y counter.

Figure 16:
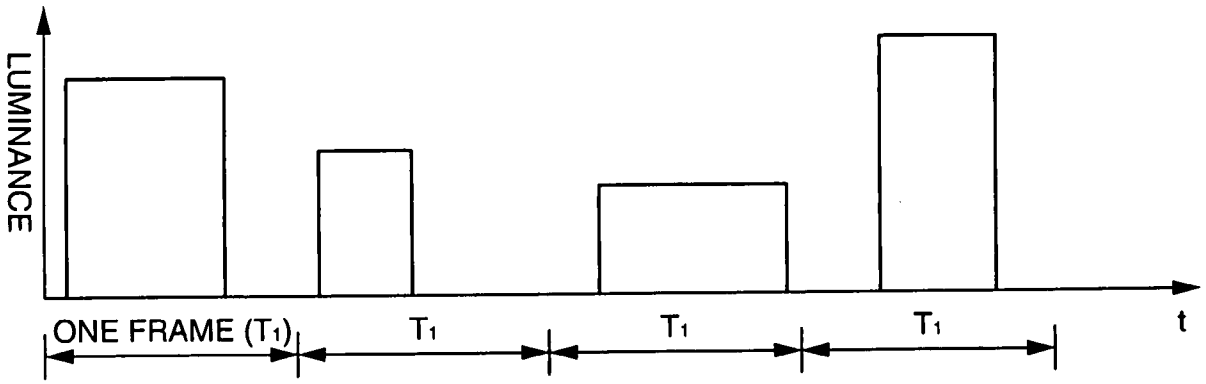
FIG. 16 illustrates a change in the luminance.

By setting the second digital data SUB in correspondence with a desired sub period or a sub frame, a sub period can be set in every frame (corresponding to the cycle $T_1$ in this embodiment), as shown in FIG. 16.

Fifth Embodiment

In order to improve the moving-picture characteristics, it is sometimes preferable that the pixel circuits provided for a plurality of scanning lines simultaneously display a black color, or the luminance is set to 0.

Figure 17:
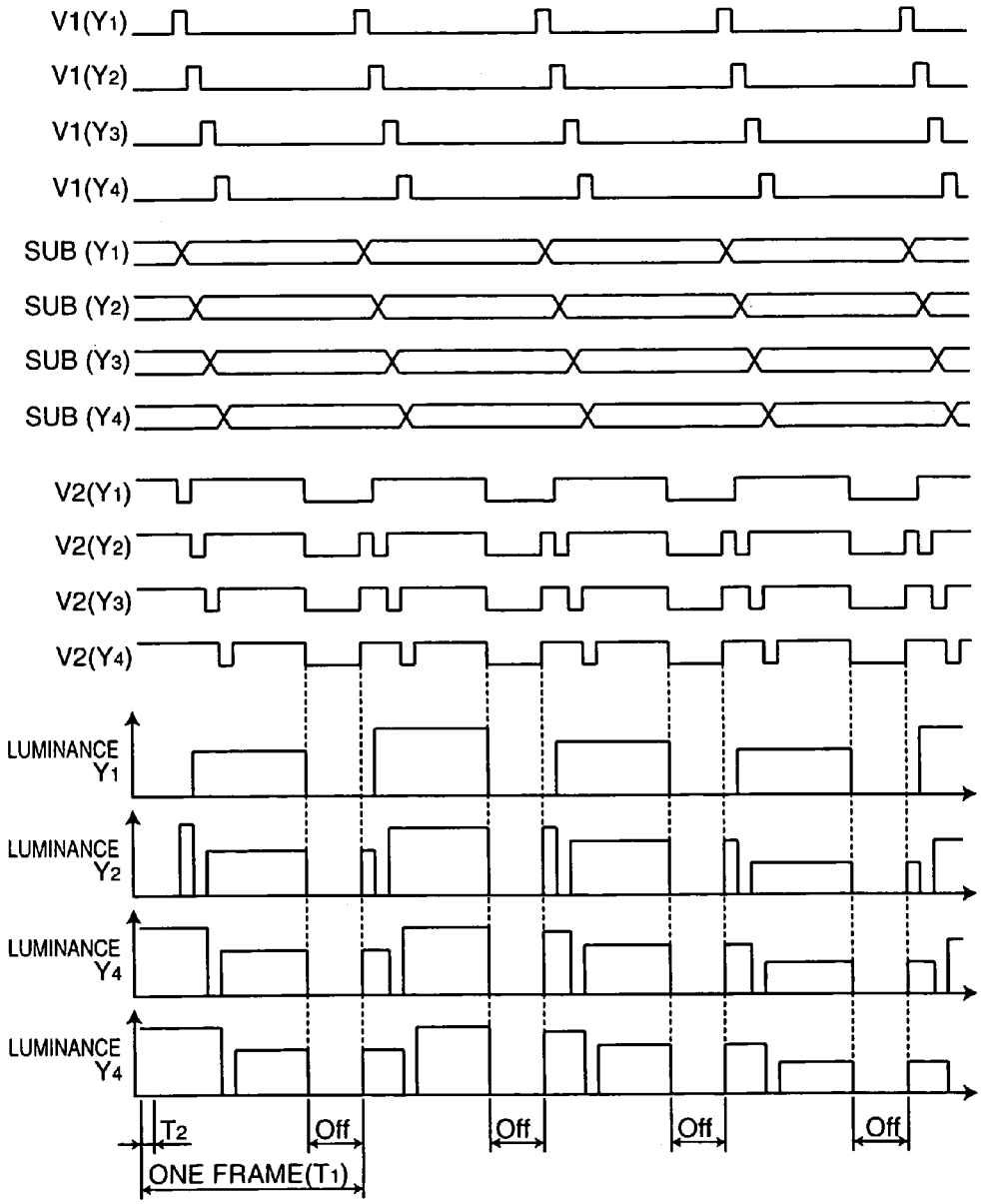
FIG. 17 illustrates timing charts of the control signals and a change in the luminance.

In this embodiment, as shown in FIG. 17, sub periods in which the luminance is 0 (indicated by Off in FIG. 17) are simultaneously set for the pixel circuits corresponding to a plurality of scanning lines.

A specific description is given below of a method for simultaneously setting a period in which the luminance becomes 0 (indicated by Off in FIG. 17) for the pixel circuits corresponding to a plurality of scanning lines.

Figure 18:
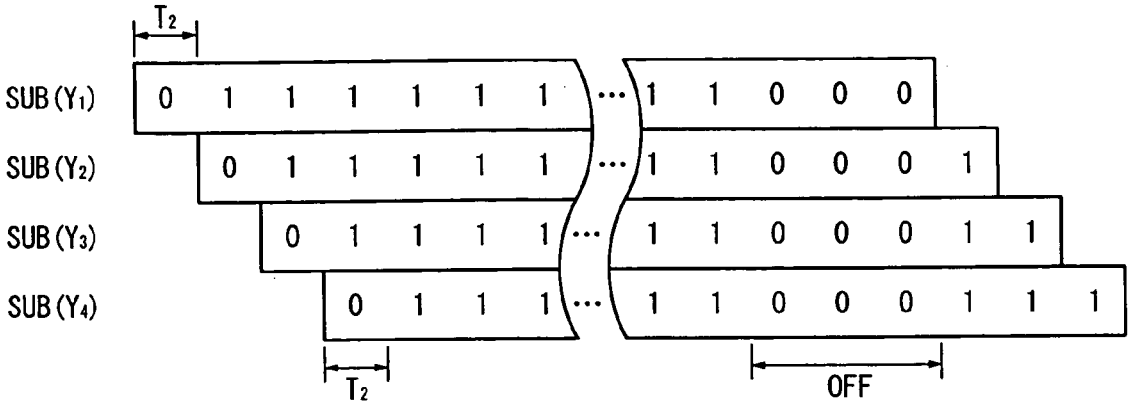
FIG. 18 illustrates an example of the configuration of second digital data SUB.

For easy representation, it is now assumed that there are four scanning lines, one of them is selected, and the time required for writing data signals is equal to the second cycle ($T_2$). In the second digital data SUB shown in FIG. 18, "1" indicates the state in which the transistor 214 and the organic EL device 220 are electrically connected via the transistor 213, and "0" indicates the state in which the transistor 214 and the organic EL device 220 are electrically disconnected. For easy understanding, in FIG. 18, the first positions of the second digital data SUB are displaced from each other.

Since the data signals are written while the transistor 213 is OFF, the second digital data SUB starts from "0". The second digital data SUB "0" is input in correspondence with sub periods with the luminance 0 which are equivalent to three portions of the second period ($T_2$).

Simultaneously with the supply of the first gate signal V1($Y_1$) via the scanning line $Y_1$, the supply of the second gate signal V2($Y_1$) generated based on the second digital data SUB($Y_1$) and corresponding to the scanning line $Y_1$ is started. As discussed above, the second gate signal V2($Y_1$) is supplied based on the second digital data SUB($Y_1$) as follows. In correspondence with "0" at the left side of the second digital data SUB($Y_1$), the second gate signal V2($Y_2$) for switching OFF the transistor 213 is supplied, and then, in correspondence with the subsequent "1" of the second digital data SUB($Y_1$), the second gate signal V2($Y_2$) for switching ON the transistor 213 is supplied, and so on.

The supply of the first gate signal V1($Y_2$) of the subsequent scanning line $Y_2$ is started by being delayed from the supply of the first gate signal V1($Y_1$) by a predetermined time, in this embodiment, it is delayed by the second cycle $T_2$. Similarly, for the scanning line $Y_2$, the second gate signal V2($Y_2$) generated based on the second digital data SUB($Y_2$) is supplied.

Thereafter, an operation similar to the above-described operation is performed, and as a result, the Off period in which the luminance of the organic EL devices 220 is simultaneously 0 can be set for all the scanning lines.

In the first through third embodiments, display apparatuses using organic EL devices have been discussed. Display apparatuses using organic EL devices can be applied to various electronic apparatuses, such as mobile personal computers, cellular telephones, and digital still cameras.

Figure 19:
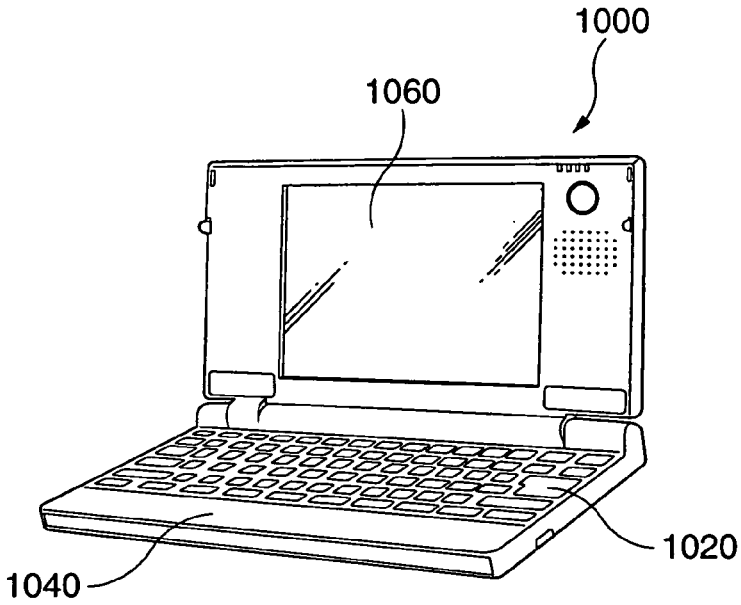
FIG. 19 is a perspective view illustrating the configuration of a mobile personal computer.

FIG. 19 is a perspective view illustrating the configuration of a mobile personal computer. A personal computer 1000 includes a main unit 1040 provided with a keyboard 1020, and a display unit 1060 using organic EL devices.

Figure 20:
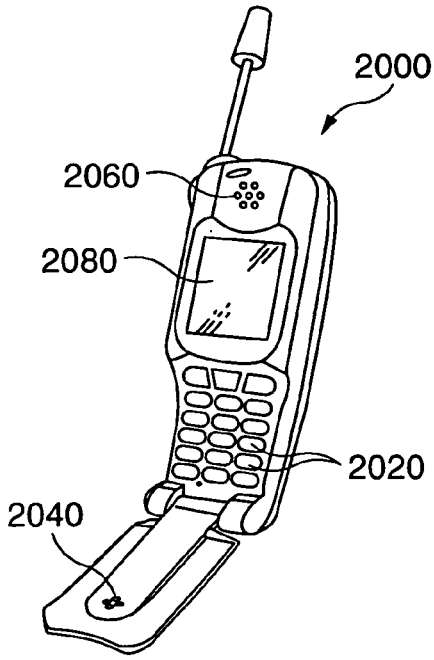
FIG. 20 is a perspective view illustrating a cellular telephone.

FIG. 20 is a perspective view illustrating a cellular telephone. A cellular telephone 2000 includes a plurality of operation buttons 2020, a mouthpiece 2040, an earpiece 2060, and a display panel 2080 using organic EL devices.

Figure 21:
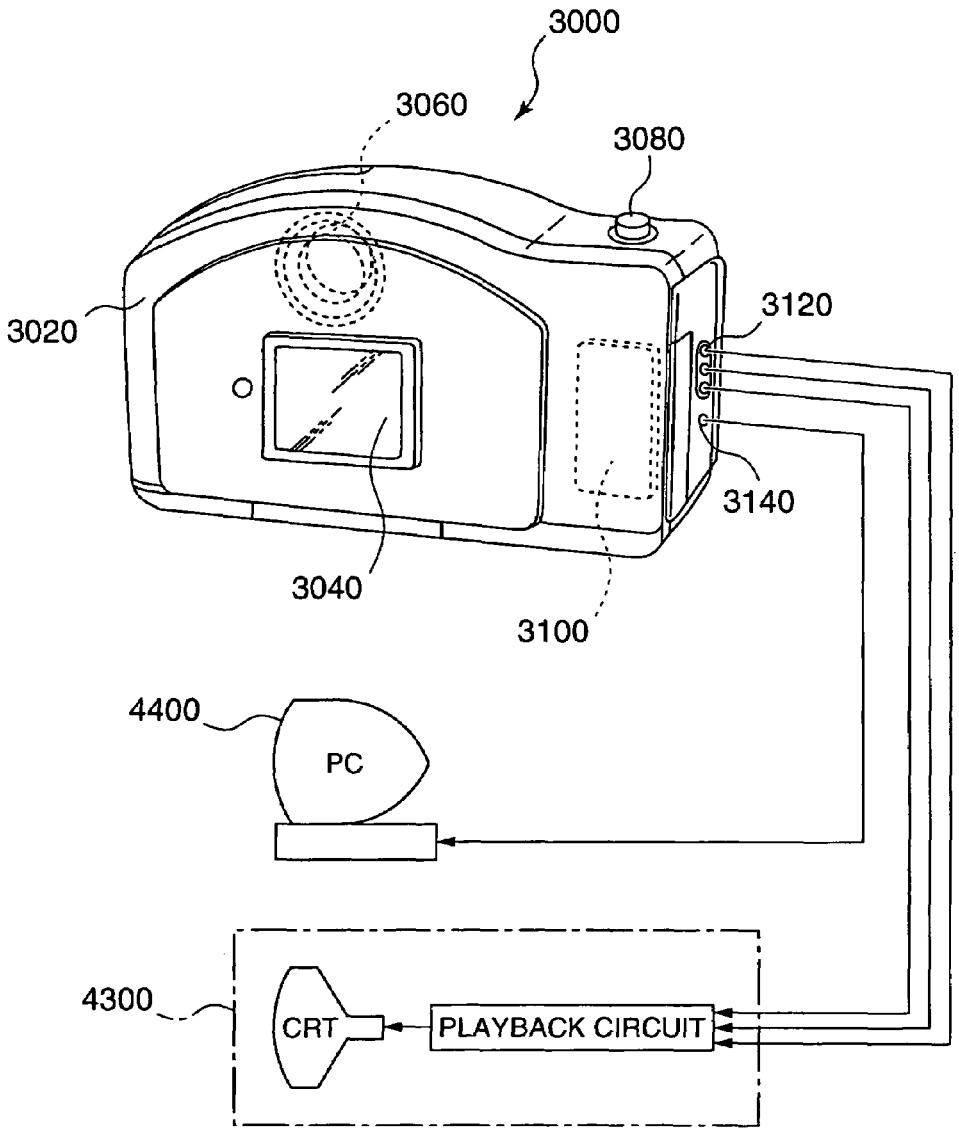
FIG. 21 is a perspective view illustrating the configuration of a digital still camera 3000.

FIG. 21 is a perspective view illustrating the configuration of a digital still camera 3000. FIG. 21 also schematically shows a connection with external devices. In regular cameras, a film is exposed to light by using an optical image of a subject. In contrast, in the digital still camera 3000, an image-capturing signal is generated by performing photoelectric conversion on an optical image of a subject by using image-capturing devices, such as CCDs (Charge Coupled Devices). A display panel 3040 using organic EL devices is provided at the rear surface of a casing 3020 of the digital still camera 3000, and performs display based on an image-capturing signal generated by the CCDs. Accordingly, the display panel 3040 functions as a finder for displaying a subject. A light receiving unit 3060 including an optical lens and the CCDs is provided at the observation side (back side in FIG. 21) of the casing 3020.

When a photographer checks a subject displayed on the display panel 3040 and presses a shutter button 3080, an image-capturing signal generated by the CCDs is transferred to and stored in the memory of a circuit substrate 3100. The digital still camera 3000 is also provided with a video signal output terminal 3120 and a data communication input/output terminal 3140 at a side surface of the casing 3020. When necessary, as shown in FIG. 21, a television monitor 4300 is connected to the video signal output terminal 3120, and a personal computer 4400 is connected to the data communication input/output terminal 3140. By a predetermined operation, the image-capturing signal stored in the memory of the circuit substrate 3100 is output to the television monitor 4300 or the personal computer 4400.

The electronic systems include, not only the personal computer shown in FIG. 19, the cellular telephone shown in FIG. 20, and the digital still camera shown in FIG. 21, but also television sets, view-finder or monitor direct-view-type video cassette recorders, car navigation systems, pagers, electronic diaries, calculators, word processors, workstations, videophones, POS (Point of Sale) terminals, and machines provided with touch panels. As the display devices of these various types of electronic systems, the above-described display apparatus using organic EL devices can be applied.

The present invention is not restricted to the above-described embodiments, and may be implemented in various modes without departing from the spirit of the invention. For example, the following modifications are possible.

In the above-described embodiments, the cycle $T_2$ is set to the same cycle as the driving cycle $T_c$. However, the cycles $T_1$ and $T_2$ are not necessarily dependent on the programming period $T_{pr}$. For example, the cycle $T_1$ may be set to the same cycle as the programming period $T_{pr}$, in which case, the programming period is switched at short time intervals by the pulse-width control of the cycle $T_1$.

Although in the example shown in FIG. 5 the resistor transistors 52 and 41 through 48 are connected to the driving transistors 32 and 21 through 28, respectively, they may be substituted by another type of resistor element (resistance addition means). Such resistor elements do not have to be connected to all the driving transistors 32 and 21 through 28, and may be provided according to the necessity.

Part of the circuit configuration shown in FIG. 5 may be omitted. For example, the offset-current generating circuit 320 may be omitted. However, by providing the offset-current generating circuit 320, the flexibility to set the range of the programming current is increased, and thus, the programming current can be easily set to a desired range.

Additionally, in the foregoing embodiments, part of or the whole transistors may be substituted by other types of switching devices, such as bipolar transistors or thin film diodes.

Although in the foregoing embodiments the display panel 101 is provided with one pixel circuit matrix, it may be provided with a plurality of pixel circuit matrixes. For example, when a large panel is formed, the display panel 101 may be divided into a plurality of adjacent areas, and a pixel circuit matrix may be provided in each area. Alternatively, three pixel circuit matrixes corresponding to three colors, i.e., RGB, may be provided in the single display panel 101. If a plurality of pixel circuit matrixes are provided, the above-described embodiments may be applicable to each matrix.

In the pixel circuits used in the above-described embodiments, as shown in FIG. 5, the programming period $T_{pr}$ and the light-emitting period $T_{e1}$ are separated. It is however possible to use pixel circuits in which the programming period $T_{pr}$ overlaps with part of the light-emitting period $T_{e1}$. In such pixel circuits, programming is performed at the first stage of the light-emitting period $T_{e1}$, so as to set the light-emission grayscale, and light emission continues with the set grayscale. It is possible to apply the data-line drive circuit 102 to an apparatus using such pixel circuits.

In the foregoing embodiments, examples of the display apparatuses using organic EL devices have been discussed. However, the present invention is applicable to display apparatuses or electronic apparatuses using light-emitting devices other than organic EL devices. The invention is applicable to, for example, apparatuses provided with other types of light-emitting devices (LED or FED (Field Emission Display) in which the light-emission grayscale can be adjusted according to the drive current.

The present invention is applicable to, not only circuits and apparatuses provided with pixel circuits which are driven by an active driving method, but also circuits and apparatuses without pixel circuits which are driven by a passive driving method.

Although the first through third embodiments signals are supplied in a predetermined cycle, they do not have to be supplied periodically.

In the above-described embodiments, one digital data is divided into two pieces of data to generate digital data DAB and SUB. In some cases, it may be divided into three pieces of data, and one of them may be used for γ correction (for example, for the reading of the memory 104). The digital data may certainly be divided into four or more pieces of data.

The invention claimed is:

1. An electro-optical apparatus, comprising:

a pixel matrix in which pixels including light-emitting devices are disposed in a matrix;

a plurality of scanning lines respectively connected to pixel groups disposed in one of a row direction and a column direction of the pixel matrix;

a plurality of data lines respectively connected to pixel groups disposed in the other one of the row direction and the column direction of the pixel matrix;

a scanning-line drive circuit connected to the plurality of scanning lines so as to select one row or one column of the pixel matrix; and a data-line drive circuit to generate, based on a digital signal, a control signal having a current value in accordance with a light-emission grayscale of the light-emitting device, and to output the generated control signal to at least one of said plurality of data lines in a predetermined period, the data-line drive circuit including a first current-value setting device to set the current value of the control signal in each first period, which is provided in the predetermined period, and a second current-value setting device to adjust the current value of the control signal in each second period, which is provided plurally in the predetermined period, and is different from the first period, and is shorter than the first period;

the first current-value setting device setting the current value of the control signal in each of the first period based on part of digital data forming the digital signal; and the second current-value setting device adjusting the current value of the control signal in each of the second period based on the remaining data other than the part of the digital data used by the first current-value setting device for a portion set by the first current-value setting device based on the same digital data of the control signal.

2. The electro-optical apparatus according to claim 1, the digital data being configured such that an upper bit indicates a higher light-emission grayscale for the light emitting device;

upper bits of the digital data being assigned to the part of the digital data; and lower bits of the digital data being assigned to the remaining data.

3. The electro-optical apparatus according to claim 2, the second period being the same period as each of divided areas obtained by equally dividing the first period by the number of bits forming the remaining data.

4. The electro-optical apparatus according to claim 2, the digital data being formed of $4n(n \geqq 1)$-bit data;

upper 3n-bit data of the digital data being assigned to the part of the data; and lower n-bit data of the digital data being assigned to the remaining data.

5. The electro-optical apparatus according to claim 1, the light-emitting devices being organic electroluminescence devices.

6. An electro-optical apparatus, comprising:

a plurality of scanning lines;

a plurality of data lines; and a plurality of pixel circuits at intersections of the plurality of scanning lines and the plurality of data lines;

data signals to be supplied to the plurality of pixel circuits via the plurality of data lines being generated based on first digital data of a pair of digital data;

signal levels to be supplied to electro-optical devices contained in the plurality of pixel circuits being determined according to the data signals; and a period control signal to set at least one sub-period in a frame period being generated based on second digital data of the pair of digital data.

7. An electronic system, comprising:

the electro-optical apparatus set forth in claim 1.

* * * * *